US008328342B2

(12) United States Patent
Irita et al.

(10) Patent No.: US 8,328,342 B2
(45) Date of Patent: Dec. 11, 2012

(54) INKJET RECORDING METHOD

(75) Inventors: Kiyoshi Irita, Kanagawa (JP); Terukazu Yanagi, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 230 days.

(21) Appl. No.: 12/753,917

(22) Filed: Apr. 5, 2010

(65) Prior Publication Data

US 2010/0259578 A1 Oct. 14, 2010

(30) Foreign Application Priority Data

Apr. 8, 2009 (JP) ..... 2009-094280

(51) Int. Cl.
*B41J 2/015* (2006.01)

(52) U.S. Cl. ..... 347/100; 347/95; 347/96; 347/98; 347/21

(58) Field of Classification Search ..... 347/95–100, 347/102, 21; 523/160, 161; 106/31.13, 31.6
See application file for complete search history.

(56) References Cited

U.S. PATENT DOCUMENTS

| | | | | |
|---|---|---|---|---|
| 7,393,069 | B2 * | 7/2008 | Kusunoki | 347/5 |
| 2006/0125895 | A1 * | 6/2006 | Nito et al. | 347/100 |
| 2009/0079784 | A1 * | 3/2009 | Chiwata et al. | 347/21 |

FOREIGN PATENT DOCUMENTS

| | | | |
|---|---|---|---|
| JP | 2004-010633 | A | 1/2004 |
| JP | 2007-099913 | A | 4/2007 |

* cited by examiner

*Primary Examiner* — Matthew Luu
*Assistant Examiner* — Rut Patel
(74) *Attorney, Agent, or Firm* — SOLARIS Intellectual Property Group, PLLC

(57) ABSTRACT

An inkjet recording method is disclosed, in which the method includes: recording an image, on a recording medium, using two or more ink compositions each comprising at least a pigment, by applying the two or more ink compositions to an acidic surface of the recording medium at a dotting interval of 500 msec or less; wherein the recording includes forming at least a first color sub-image by applying at least one of the two or more ink compositions and the at least one of the two or more ink compositions includes a self-dispersing polymer having an acid value of from 70 to 120 mgKOH/g and a water-soluble organic solvent.

17 Claims, 2 Drawing Sheets

INKJET RECORDING METHOD

CROSS-REFERENCE TO RELATED APPLICATION

This application claims priority under 35 USC 119 from Japanese Patent Application No. 2009-094280, filed on Apr. 8, 2009, the disclosure of which is incorporated by reference herein.

BACKGROUND OF THE INVENTION

1. Field of the Invention

The present invention relates to an inkjet recording method in which ink is discharged to record an image by an inkjet method.

2. Description of the Related Art

Various methods have recently been proposed as image recording methods for recording color images. In each method, desired qualities of printed materials are high, including image quality, texture, and post-recording curl.

For example, inkjet techniques have been used for office printers, home printers, and the like. Application of inkjet techniques to commercial printing has been expected in order to address a requirement of POD (print on demand) in a recent year. In commercial printing, a surface of the printed sheet is required to have a texture, similar to that of general printing paper, rather than a surface, such as that of a photograph, that completely blocks penetration of ink solvent into base paper.

From the viewpoint of obtaining an image having a texture similar to that of the printed materials, pigment inks, which have been used in off-set printing, have attracted attention in the field of inkjet recording. Further, from the viewpoint of reducing environmental burdens, water-based inks are more desirable than solvent-based inks. Under such circumstances, recording of an image by an inkjet method using a water-based pigment ink is widely performed. However, since pigment inks generally have a poor abrasion resistance, a technique of incorporating latex in the ink as a binder component is known.

Further, there is demand for carrying out recording at a higher speed than ever in the recording method utilizing an inkjet technique. In this regard, for example, Japanese Patent Application Laid-Open (JP-A) No. 2004-10633 discloses an ink set for inkjet recording that includes an ink containing a pigment and a liquid composition that has a function of coagulating the ink, wherein one of the ink or the liquid composition is alkaline and the other is acidic.

Further, JP-A No. 2007-99913 discloses an ink that includes a pigment dispersed therein with a polymer having an acid value of from 50 to 120 mg KOH/g, and a resin emulsion of resin particles formed from a polymer having an acid value of from 50 to 120 mg KOH/g.

SUMMARY OF THE INVENTION

However, when recording is carried out at high speed by an inkjet technique using a pigment ink and a separate liquid that coagulates the ink, there are problems as described below. Specifically, for example, when the recording time is shortened by reducing the time interval between the dotting of an ink of a first color and the dotting of an ink of a second color, the ink of the second color or later, which is dotted so as to put on the previously formed ink dot of the first color, may not sufficiently coagulate.

As a result, the dot of ink droplet of the second color or later may spread outward despite the expectations for improving image quality and increasing the recording speed by the action of coagulation. The larger the dot diameter of the ink is, the more difficult it is to delineate fine lines or fine portions of the image in a precise and uniform manner, thereby decreasing the resolution of the image. In particular, as the recording speed increases, it becomes more difficult to obtain a desired image having a high resolution.

The present invention has been made in view of the aforementioned circumstances, and provides an inkjet recording method in which a high-quality image can be recorded at high speed by suppressing variation in the dot diameters of ink droplet between different inks that is caused by, for example, insufficient coagulation of the ink droplet that occurs when a multicolor image is recorded.

According to the following first aspect of the invention, there is provided an inkjet recording method that is able to address the aforementioned problems.

<1> An inkjet recording method including:

recording an image, on a recording medium, using two or more ink compositions each comprising at least a pigment; by applying the two or more ink compositions to an acidic surface of the recording medium at a dotting interval of 500 msec or less; wherein the recording includes forming at least a first color sub-image by applying at least one of the two or more ink compositions and the at least one of the two or more ink compositions includes a self-dispersing polymer having an acid value of from 70 to 120 mgKOH/g and a water-soluble organic solvent.

BRIEF DESCRIPTION OF THE DRAWINGS

Exemplary embodiments of the present invention will be described in detail based on the following figures, wherein.

DETAILED DESCRIPTION OF THE INVENTION

Figure 1:
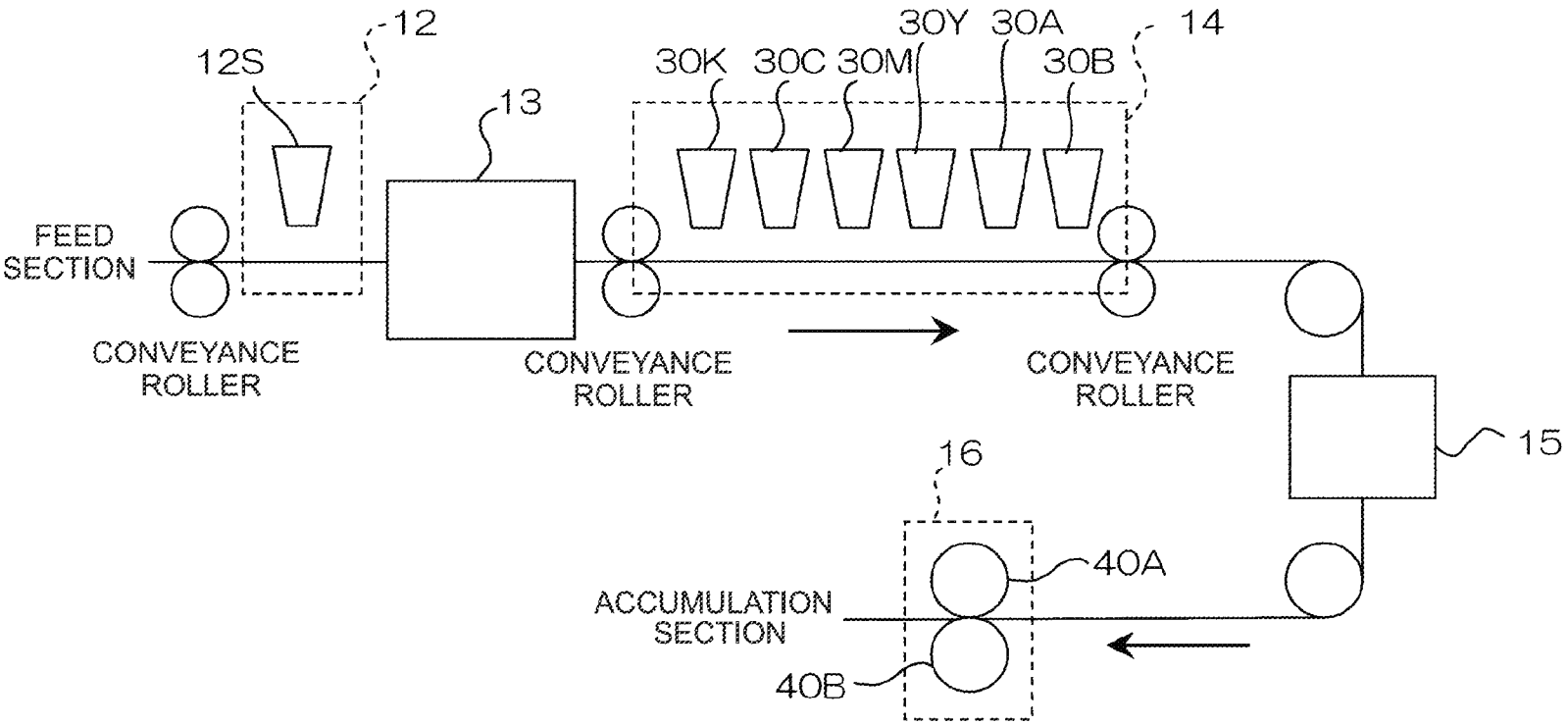
FIG. 1 is a rough schematic diagram illustrating an example of the configuration of an inkjet recording device used for the inkjet recording method according to the present invention.

According to the following second to seventeenth aspects of the invention, there are provided more favorable inkjet recording methods that are able to address the aforementioned problems.

<2> The inkjet recording method according to <1>, wherein the recording medium includes, at least at a side of the recording medium on which the image is recorded, an acidic substance that forms the acidic surface and that coagulates or insolubilizes a component of the ink composition, and the ink composition is applied to the side of the recording medium that comprises the acidic substance.

<3> The inkjet recording method according to <1> or <2>, further including, prior to recording the image, a process of forming the acidic surface by applying a treatment liquid to a region of the recording medium to which the inkjet composition is to be applied, the treatment liquid including an acidic substance that coagulates or insolubilizes the component of the ink composition.

<4> The inkjet recording method according to any one of <1> to <3>, wherein the pigment is a water-dispersible pigment having at least a portion of a surface thereof coated with a polymer dispersant.

<5> The inkjet recording method according to <4>, wherein the polymer dispersant has a carboxyl group.

<6> The inkjet recording method according to <4> or <5>, wherein the polymer dispersant has an acid value of from 70 to 120 mgKOH/g.

<7> The inkjet recording method according to any one of <4> to <6>, wherein the weight average acid value of the self-dispersing polymer and the polymer dispersant is from 70 to 120 mgKOH/g.

<8> The inkjet recording method according to any one of <1> to <7>, wherein the ink composition is applied, in a maximum jetting amount of 15 $ml/m^2$ or less, to the acidic surface that includes an acidic substance in an amount of from 0.2 to 0.7 $g/m^2$.

<9> The inkjet recording method according to any one of <1> to <8>, wherein the volume average particle diameter of the self-dispersing polymer is 50 nm or less.

<10> The inkjet recording method according to <2>, wherein the acid substance is a divalent or more polyvalent organic acid.

<11> The inkjet recording method according to <10>, wherein the divalent or more polyvalent organic acid is an organic acid having a first pKa of 3.5 or less.

<12> The inkjet recording method according to claim 3, wherein the content of the acidic substance included in the treatment liquid is from 1 to 50% by mass with respect to the treatment liquid.

<13> The inkjet recording method according to <3>, further including drying the treatment liquid on the recording medium by heating during a period from after the application of the treatment liquid onto the recording medium until the application of the ink composition.

<14> The inkjet recording method according to any one of <1> to <13>, wherein the recording medium is a coated paper medium including a base paper and a coating layer including an inorganic pigment.

<15> The inkjet recording method according to any one of <1> to <14>, wherein the ink composition includes water in an amount of from 10% to 99% by mass with respect to the ink composition.

<16> An inkjet recording method including:

recording an image, on a recording medium, using a combination of two or more ink compositions, each including at least a pigment, and a treatment liquid that includes an organic acid, by applying the two or more ink compositions to an acidic surface of the recording medium at a dotting interval of 500 msec or less; wherein the recording includes forming at least a first color sub-image by applying at least one of the two or more ink compositions and the ink composition forming the at least a first color sub-image includes a water-dispersible pigment coated with a polymer dispersant having a carboxylic group and an acid value of from 70 to 120 mgKOH/g, particles of a self-dispersing polymer having an acid value of from 70 to 120 mgKOH/g and a water-soluble organic solvent.

<17> An inkjet recording method including:

recording an image, on a recording medium, using a combination of two or more ink compositions, each including at least a pigment, and a treatment liquid that includes a divalent or more polyvalent organic acid, by applying the two or more ink compositions to an acidic surface of the recording medium at a dotting interval of 500 msec or less; wherein the recording includes forming at least a first color sub-image by applying at least one of the two or more ink compositions and the ink composition forming the at least a first color sub-image includes a water-dispersible pigment coated with a polymer dispersant having a carboxylic group and an acid value of from 75 to 120 mgKOH/g, particles of a self-dispersing polymer having an acid value of from 90 to 120 mgKOH/g, and a water-soluble organic solvent.

According to the invention, it is possible to provide an inkjet recording method in which a high-quality image can be recorded at high speed by suppressing variation in the dot diameters of ink droplet between different inks that is caused by, for example, insufficient coagulation of the ink droplet that occurs when a multicolor image is recorded.

In the following, details of the inkjet recording method of the invention are described.

The inkjet recording method according to the invention is a process of recording an image using two or more ink compositions each including at least a pigment. The process of recording an image includes a process of applying the two or more ink compositions to an acidic surface of a recording medium at a dotting interval of 500 msec or less. Moreover, in the process of recording an image, at least a first image of a first color of a multicolor image recorded by applying inks of two or more colors, is recorded by applying at least one of the two or more ink compositions, the at least one of the two or more ink compositions including a self-dispersing polymer having an acid value of from 70 to 120 mg KOH/g and a water-soluble organic solvent together with the pigment.

Preferably, the inkjet recording method according to the invention further includes, prior to the application of the ink composition, a process of applying a treatment liquid that contains an acidic substance that coagulates and/or insolubilizes a component of the ink composition, to a region of the recording medium to which the ink composition is to be applied. The method may further include other processes, as necessary.

In the invention, an image is recorded at high speed using two or more kinds of pigment-based ink composition (hereinafter, simply referred to as "ink") by dotting the ink compositions of different kinds at a dotting interval of as short as 500 msec or less. In this case, when at least a first-order color image of the desired image, which is formed from the ink of a first kind (first color), is formed from an ink that contains a self-dispersing polymer having an acid value of from 70 to 120 mg KOH/g, consumption of acid at the acidic surface of the recording medium prior to the application of the ink of a second kind (for example, a second color) or later following formation of the first-order color image can be suppressed. Additionally, since the portion itself that is formed from the first-order color image has a low pH and functions as a buffer that aids the coagulation of the ink of a second kind or later, coagulation of ink can be maintained when the ink of a second kind (for example, a second color) is applied so as to contact the first-order color image (for example, so as to overlap the first-order color image), even at a reduced dotting interval. Accordingly, it is possible to effectively prevent the dot diameter of the ink of the second kind (for example, second color) from increasing too much with respect to the dot diameter of the ink of the first kind (for example, the first color).

The aforementioned explanation also applies to the relationship of an n-order color image (for example, a second-order color image), which is formed by applying an ink of the n-th kind (n is 2 or greater; for example, the second kind), and an ink of the (n+1)-th kind (for example, a third-order color image).

In this way, a high-quality image can be formed in a stable manner with highly uniform ink dots of different kinds, as well as precisely and uniformly delineated fine lines or fine portions of the image, even if the image is formed using inks of different kinds, for example, thereby forming multi colors.

In the image recording method according to the invention, after applying one of the two or more ink compositions, the other one or more kinds of ink composition is or are applied thereon within 500 msec after the completion of the previous application. At this time, only the first ink composition (the first color) may include a self-dispersing polymer having an acid value of from 70 to 120 mgKOH/g, or when three or more kinds of ink composition are used, the first two ink compositions (for example, the first color and the second color) may include a self-dispersing polymer having an acid value of from 70 to 120 mgKOH/g, respectively. It is also possible that all of the ink compositions include a self-dispersing polymer having an acid value of from 70 to 120 mgKOH/g.

Ink Composition

Next, details of the ink composition used for the inkjet recording method of the invention are described.

In the invention, two or more kinds of ink composition are used, and each of these ink composition includes at least a pigment. Further, at least one of the ink compositions includes, in addition to the pigment, a self-dispersing polymer having an acid value of from 70 to 120 mg KOH/g and a water-soluble organic solvent. The ink composition according to the invention may generally include water, and further additives such as a surfactant, as necessary.

Pigment

The ink composition in the present invention includes at least one pigment as a colorant component. The pigment is not particularly limited, and may be selected appropriately according to the purpose. For example, the pigment may be an organic pigment or an inorganic pigment. The pigment is preferably almost completely insoluble in water or hardly-soluble in water, in terms of ink coloring properties.

Examples of the organic pigment include azo pigments, polycyclic pigments, dye chelates, nitro pigments, nitroso pigments, and aniline black. Among these, azo pigments and polycyclic pigments are preferable.

Examples of the inorganic pigment include titanium oxide, iron oxide, calcium carbonate, barium sulfate, aluminum hydroxide, barium yellow, cadmium red, chromium yellow, and carbon black. Among these, carbon black is preferable.

Dispersant

The ink composition of the present invention may contain at least one dispersant. The dispersant for dispersing a pigment may be either a polymeric dispersant or a low-molecular surfactant-type dispersant. The polymeric dispersant may be either water-soluble or water-insoluble.

With the low-molecular surfactant-type dispersant, a pigment can be dispersed in an aqueous medium in a stable manner, while maintaining the viscosity of the ink at a low level. The low-molecular surfactant-type dispersant is a low-molecular dispersant having a molecular weight of 2,000 or less, preferably from 100 to 2,000, and more preferably from 200 to 2,000.

The low-molecular surfactant-type dispersant mentioned above has a structure containing a hydrophilic group and a hydrophobic group. The number of hydrophilic groups and the number of hydrophobic groups per one molecule are each independently one or more. The low-molecular surfactant-type dispersant may include plural kinds of hydrophilic group and/or plural kinds of hydrophobic group. The low-molecular surfactant-type dispersant may include a linking group that links the hydrophilic group and the hydrophobic group, as appropriate.

Examples of the hydrophilic group include an anionic group, a cationic group, a nonionic group, or a betaine-type group that is formed by a combination of these groups.

The anionic group is not particularly limited as long as the group has a negative charge. The anionic group is preferably a phosphoric acid group, a phosphonic acid group, a phosphinic acid group, a sulfuric acid group, a sulfonic acid group, a sulfinic acid group, or a carboxyl acid group, more preferably a phosphoric acid group or a carboxyl acid group, and still more preferably a carboxyl acid group. The cationic group is not particularly limited as long as the group has a positive charge. The cationic group is preferably an organic cationic group, more preferably a cationic group of nitrogen or phosphorous, and further preferably a pyridinium cationic group or an ammonium cationic group. Examples of the nonionic group include polyethylene oxide, polyglycerin, and a sugar unit of a certain kind.

The hydrophilic group is preferably an anionic group as described above.

When the low-molecular surfactant-type dispersant has an anionic hydrophilic group, the dispersant preferably has a pKa of 3 or more, in terms of promoting coagulation reaction upon contacting with an acidic treatment liquid. The pKa mentioned here is an experimentally-obtained value based on a titration curve which is obtained by titrating a 1 mmol/L solution of a low-molecular surfactant-type dispersant in tetrahydrofuran/water at a ratio of 3:2 (THF:water, V/V) with an acid or alkali aqueous solution. When the pKa of the low-molecular surfactant-type dispersant is 3 or more, 50% or more of the anionic groups theoretically become undissociated upon contact with a liquid having a pH of around 3. Accordingly, the water-solubility of the low molecular surfactant-type dispersant is significantly reduced, as a result of which a coagulation reaction occurs, namely, the coagulation reactivity is improved. From this point of view, the low-molecular surfactant-type dispersant preferably has a carboxyl acid group as an anionic group.

The hydrophobic group has, for example, a hydrocarbon structure, a fluorocarbon structure, of a silicone structure, and the hydrocarbon structure is preferable. The hydrophobic group may have either a straight-chain structure or a branched structure. Further, the hydrophobic group may have a single-chain structure or multi-chain structure. When there are two or more chains, the chains may include two or more kinds of hydrophobic group. The hydrophobic group is preferably a hydrocarbon group having a carbon number of from 2 to 24, more preferably from 4 to 24, and yet more preferably from 6 to 20.

When the polymeric dispersant is a water-soluble dispersant, examples thereof include a hydrophilic polymeric dispersant. Examples of natural hydrophilic polymeric compounds include plant polymers such as gum arabic, gum tragacanth, guar gum, gum karaya, locust bean gum, arabinogalactan, pectin and quince seed starch, algae polymers such as alginic acid, carrageenan and agar, animal polymers such as gelatin, casein, albumin and collagen, and microbial polymers such as xanthene gum and dextran.

Examples of hydrophilic polymeric compounds obtained by modifying natural raw materials include fibrous polymers such as methyl cellulose, ethyl cellulose, hydroxyethyl cellulose, hydroxypropyl cellulose and carboxymethyl cellulose, starch polymers such as sodium starch glycolate (sodium salt of starch glycolate), and sodium starch phosphate (sodium salt of starch phosphate [ester]), and algae polymers such as sodium alginate and propylene glycol alginate.

Examples of synthetic hydrophilic polymeric compounds include vinyl polymers such as polyvinyl alcohol, polyvinyl pyrrolidone and polyvinyl methyl ether; acrylic resins such as non-crosslinked polyacrylamide, polyacrylic acid or an alkali metal salt thereof, and water-soluble styrene acrylic resins; water-soluble styrene maleic acid resin; water-soluble vinylnaphthalene acrylic resin; water-soluble vinylnaphthalene maleic acid resins; polyvinyl pyrrolidone; alkali metal salts of formalin condensates of β-naphthalene sulfonic acid; polymeric compounds having, at a side chain, a salt of a cationic functional group such as a quaternary ammonium group or an amino group; and natural polymeric compounds such as shellac.

Among these, water-soluble dispersants to which a carboxyl group is introduced are preferable, and examples thereof include homopolymers of acrylic acid, methacrylic acid or styrene acrylic acid, and copolymers thereof with another monomer having a hydrophilic group.

When the polymeric dispersant is a water-insoluble dispersant, the water-insoluble dispersants include a polymer having both hydrophilic and hydrophobic moieties, such as styrene-(meth)acrylic acid copolymer, styrene-(meth)acrylic acid-(meth)acrylate copolymer, (meth)acrylate-(meth) acrylic acid copolymer, polyethylene glycol(meth)acrylate-(meth)acrylic acid copolymer, vinyl acetate-maleic acid copolymer, and styrene-maleic acid copolymer.

The weight average molecular weight of the polymer dispersant is preferably from 3,000 to 100,000, more preferably from 5,000 to 50,000, further preferably from 5,000 to 40,000, and yet further preferably from 10,000 to 40,000.

The acid value of the polymer dispersant is preferably in the range of 70 to 100 mg KOH/g, from the viewpoint of maintaining good coagulation properties when one kind (for example, first color) ink composition of two (for example, second color) or more kind ink compositions is applied and then one or two (for example, second color) or more kind ink compositions other than the one kind ink composition is put on the applied ink composition (for example, first-order color image of first color). Further, in view of the same reason as described above, the acid value is more preferably from 75 mgKOH/g to 120 mgKOH/g, and still more preferably from 90 mgKOH/g to 120 mgKOH/g.

The polymer dispersant preferably includes a polymer having a carboxyl group, and more preferably a polymer having a carboxyl group and an acid value of from 70 mgKOH/g to 120 mgKOH/g, from the viewpoint of the coagulation speed at the time when the self-dispersing polymer contacts the treatment liquid.

The mixing ratio by mass of pigment (p) to dispersant (s) (p:s) is preferably in a range of from 1:0.06 to 1:3, more preferably in a range of from 1:0.125 to 1:2, and still more preferably in a range of from 1:0.125 to 1:1.5.

In the invention, in view of light fastness or quality of the image, the ink composition preferably includes a pigment and a dispersant, more preferably an organic pigment and a polymer dispersant, and particularly preferably an organic pigment and a polymer dispersant having a carboxyl group. Further, in view of coagulability, the pigment is preferably coated with a polymer dispersant having a carboxyl group and is insoluble in water.

The average particle diameter of the pigment is preferably from 10 to 200 nm, more preferably from 10 to 150 nm, and further preferably from 10 to 100 nm. When the average particle diameter is 200 nm or less, favorable color reproducibility and dotting properties upon dotting by an inkjet method can be achieved. When the average diameter is 10 nm or greater, favorable light fastness can be achieved. The particle size distribution of the colorant is not particularly limited, and the colorant may have a wide range of particle size distribution or a monodispersible particle size distribution. Further, two or more kinds of colorant each having a monodispersible particle size distribution may be used in combination.

The average particle diameter and the particles size distribution of the pigment (colorant) particles can be obtained by measuring the volume-average particles diameter of the same by a dynamic light scattering method, using a nanotrack particle size distribution measurement device (UPA-EP150, trade name, manufactured by Nikkiso Co., Ltd.)

The pigment may be used alone or in combination of two or more kinds.

From the viewpoint of image density, the content of the pigment with respect to the total mass of the ink composition is preferably from 1 to 25% by mass, more preferably from 2 to 20% by mass, further preferably from 5 to 20% by mass, and particularly preferably from 5 to 15% by mass.

Self-Dispersing Polymer

At least one kind of the ink composition according to the invention includes at least one kind of a self-dispersing polymer having an acid value of from 70 to 120 mgKOH/g. This self-dispersing polymer has a function of instabilizing the dispersed state of the ink composition to coagulate the same, when it contacts a treatment liquid containing an acidic substance (described below) or a region of a recording medium in which an acidic substance has been incvorporated, thereby increasing the viscosity of the ink itself and fixing the image. As a result, fixability of the image to the recording medium or abrasion resistance of the image can be further improved.

By particularly selecting a self-dispersing polymer from polymers of various kinds, it is possible to reduce the amount of an emulsifier being in a free state, which is usually mixed in an ink composition liquid when incorporating resin particles in the liquid, or removing the same from the ink composition. As a result, a coagulating component becomes functional more directively, and the coagulation of the component in the ink composition proceeds more rapidly. Accordingly, bleeding or intercolor mixing caused by the interference among ink droplets can be suppressed, and an image having excellent color hue and delineation property (reproducibility of fine lines or fine portions of the image) can be obtained at higher speed.

In the invention, the acid value of the self-dispersing polymer is particularly specified to a relatively higher range of from 70 to 120 mgKOH/g. When the acid value is less than 70 mgKOH/g, a dot diameter of the ink droplet, which is dotted in contact (for example, in overlapping manner) with the first-order color image formed from the ink of the first kind (for example, the first color), tends to become too large with respect to the first-order color image. In contrast, when the acid value is greater than 120 mgKOH/g, the amount of acidic substance in the treatment liquid to be previously applied to the recording medium is needed to increase in accordance with enhanced acid dependency. From the viewpoint of reducing influence from irregularities of the treatment liquid and further stabilizing the dot diameter, the acid value of the self-dispersing polymer is preferably from 75 to 120 mgKOH/g, and more preferably from 90 to 120 mgKOH/g.

The acid value described in the present specification is measured by a method according to JIS standard (JIS K0070: 1992).

The self-dispersing polymer is not particularly limited as long as it satisfies the aforementioned range of acid value, and a latex containing particles of a self-dispersing polymer is also applicable.

The self-dispersing polymer is a water-insoluble polymer that does not contain a free emulsifier and that can get into a dispersed state in an aqueous medium, even in the absence of the other surfactants, due to a functional group (particularly, an acidic group or a salt thereof) which the polymer itself has.

The scope of the term, "dispersed state", used herein includes an emulsified state (emulsion) in which a water-insoluble polymer in the liquid state is dispersed in an aqueous medium and a state (suspension) in which a water-insoluble polymer in the solid state is dispersed in an aqueous medium.

The water-insoluble polymer used in the present invention is preferably a water-insoluble polymer that can get into a dispersed state in which the water-insoluble polymer is dispersed in the solid state, in consideration of the coagulation speed and the fixability when the water-insoluble polymer is contained in a liquid composition.

The following procedure can be used to determine whether a water-insoluble polymer is a self-dispersing polymer as mentioned herein: 30 g of a water-insoluble polymer is dissolved in 70 g of an organic solvent (such as methyl ethyl ketone) to form a solution, the solution is mixed with 200 g of water and a neutralizing agent that can neutralize the salt-forming groups of the water-insoluble polymer to a degree of 100% (the neutralizing agent being sodium hydroxide if the salt-forming groups are anionic, or acetic acid if the salt-forming groups are cationic), the mixture is stirred with a stirrer having a stirring blade at a rotation rate of 200 rpm at 25° C. for 30 minutes, and the organic solvent is removed from the mixture liquid. If a stable dispersion state of the water-insoluble polymer in the mixture liquid is confirmed by visual observation for at least one week at 25° C. after the removal of the organic solvent, the water-insoluble polymer is considered to be a self-dispersing polymer.

The term "water-insoluble polymer" used herein refers to a polymer that shows a solubility of 10 g or less when the polymer is dried at 105° C. for 2 hours and then dissolved in 100 g of water at 25° C. The solubility is preferably 5 g or less, and more preferably 1 g or less. The solubility mentioned above is a value measured after the polymer is 100% neutralized with either sodium hydroxide or acetic acid depending on the kind of the salt-forming groups of the water-insoluble polymer.

The aqueous medium includes water and, optionally, a hydrophilic organic solvent. In the present invention, the aqueous medium is preferably formed by water and a hydrophilic organic solvent whose amount is 0.2% by mass or less with respect to the amount of the water, and is more preferably formed by water only.

The main chain backbone of the water-insoluble polymer is not particularly limited, and may be, for example, a vinyl polymer or a condensed polymer (such as an epoxy resin, polyester, polyurethane, polyamide, cellulose, polyether, polyurea, polyimide, or polycarbonate). Among them, a vinyl polymer is preferable.

Preferable examples of the vinyl polymer and the monomer or monomers for forming the vinyl polymer include those described in JP-A Nos. 2001-181549 and 2002-88294. A vinyl polymer may be used which has a dissociative group introduced to a terminal of the polymer chain; the dissociative group may be introduced by radical polymerization of a vinyl monomer using a chain transfer agent, polymerization initiator, or iniferter that has the dissociative group (or a substituent that can be converted to the dissociative group), or by ion polymerization using a compound having the dissociative group (or a substituent that can be converted to the dissociative group) as either of an initiator or a terminator.

Preferable examples of the condensed polymer and the monomers for forming the condensed polymer include those described in JP-A No. 2001-247787.

The self-dispersing polymer particles preferably include a water-insoluble polymer having a hydrophilic structural unit and a hydrophobic structural unit derived from a monomer containing an aromatic group, from the viewpoint of self-dispersing property.

The hydrophilic structural unit is not particularly limited as long as it is derived from a monomer containing a hydrophilic group. The hydrophilic structural unit may be derived from only one type of hydrophilic-group-containing monomer or from two or more types of hydrophilic-group-containing monomer. The hydrophilic group is not particularly limited, and may be a dissociative (dissociable) group or a nonionic hydrophilic group.

In the present invention, the hydrophilic group is preferably a dissociative group, and more preferably an anionic dissociative group, from the viewpoints of enhancing self-dispersing property and providing stability of the formed emulsion or dispersion state. The dissociative group may be, for example, a carboxyl group, a phosphoric acid group, or a sulfonic acid group. In particular, a carboxyl group is preferable as the dissociative group, in consideration of the fixability of an ink composition that is formed using the self-dispersing polymer.

The hydrophilic-group-containing monomer in the present invention is preferably a monomer containing a dissociative group, and more preferably a monomer containing a dissociative group and an ethylenic unsaturated bond, in consideration of self-dispersing property and coagulation property.

The dissociative-group-containing monomer may be, for example, an unsaturated carboxylic acid monomer, an unsaturated sulfonic acid monomer, or an unsaturated phosphoric acid monomer Examples of the unsaturated carboxylic acid monomer include acrylic acid, methacrylic acid, crotonic acid, itaconic acid, maleic acid, fumaric acid, citraconic acid, and 2-methacryloyloxymethylsuccinic acid.

Examples of the unsaturated sulfonic acid monomer include styrenesulfonic acid, 2-acrylamide-2-methylpropane sulfonic acid, 3-sulfopropyl(meth)acrylate, and bis-(3-sulfopropyl)itaconate.

Examples of the unsaturated phosphoric acid monomer include vinyl phosphonic acid, vinyl phosphate, bis(methacryloxyethyl)phosphate, diphenyl-2-acryloyloxyethyl phosphate, diphenyl-2-methacryloyloxyethyl phosphate, and dibutyl-2-acryloyloxyethyl phosphate.

Among the above dissociative-group-containing monomers, unsaturated carboxylic acid monomers are preferable, acrylic monomers and methacrylic monomers are more preferable, and acrylic acid and methacrylic acid are still more preferable, in consideration of dispersion stability and jetting stability.

The self-dispersing polymer particles in the present invention preferably contains a polymer having a carboxyl group, more preferably contains a polymer having a carboxyl group and an acid value of from 70 mgKOH/g to 120 mgKOH/g, and still more preferably contains a polymer having a carboxyl group and an acid value of from 90 mgKOH/g to 90 mgKOH/g, from the viewpoint of self-dispersing property and coagulation speed at the time of contact with the treatment liquid.

The aromatic-group-containing monomer is not particularly limited as long as the monomer is a compound containing an aromatic group and a polymerizable group. The aromatic group may be a group derived from an aromatic hydrocarbon or from an aromatic heterocycle. In the present invention, the aromatic group is preferably an aromatic group derived from an aromatic hydrocarbon, from the viewpoint of improving the stability of the particle shape in an aqueous medium.

The polymerizable group may be a condensation-polymerizable group or an addition-polymerizable group. In the present invention, the polymerizable group is preferably an addition-polymerizable group, and more preferably a group containing an ethylenic unsaturated bond, from the viewpoint of improving the stability of the particle shape in an aqueous medium.

The aromatic-group-containing monomer in the present invention is preferably a monomer having an aromatic group derived from an aromatic hydrocarbon and an ethylenic unsaturated bond. The aromatic-group-containing monomer may be used singly or in combination of two or more thereof.

Examples of the aromatic-group-containing monomer include phenoxyethyl(meth)acrylate, benzyl(meth)acrylate, phenyl(meth)acrylate, and a styrene-based monomer. In particular, from the viewpoint of improving the balance between the hydrophilicity and hydrophobicity of the polymer chain and ink fixability, an aromatic-group-containing (meth)acrylate monomer is preferable, and at least one selected from phenoxyethyl(meth)acrylate, benzyl(meth)acrylate, or phenyl(meth)acrylate is more preferable, and phenoxyethyl (meth)acrylate and benzyl(meth)acrylate are still more preferable.

The term "(meth)acrylate" used herein refers to acrylate or methacrylate.

In the present invention, the self-dispersing polymer is preferably an acrylic resin containing a structural unit derived from a (meth)acrylate monomer, more preferably a (meth) acrylic resin containing a structural unit derived from an aromatic-group-containing (meth)acrylate monomer, and still more preferably a (meth)acrylic monomer containing a structural unit derived from an aromatic-group-containing (meth)acrylate monomer at a content of from 10 to 95% by mass. When the content of the aromatic-group-containing (meth)acrylate monomer is from 10 to 95% by mass, stability of self-emulsification or dispersion state improves, and, further, an increase in the ink viscosity can be suppressed.

In the present invention, the content of the aromatic-group-containing (meth)acrylate monomer is more preferably from 15 to 90% by mass, still more preferably from 15 to 80% by mass, and particularly preferably from 25 to 70% by mass, from the viewpoints of improving stability of the self-dispersing state, stabilizing the particle shape in an aqueous medium through hydrophobic interaction between aromatic rings, and reducing the amount of water-soluble components by imparting appropriate hydrophobicity to the particles.

In the present invention, the self-dispersing polymer may include, for example, a structural unit derived from an aromatic-group-containing monomer and a structural unit derived from a dissociative-group-containing monomer. The self-dispersing polymer may further include another structural unit, as necessary.

The monomer for forming another structural unit is not particularly limited as long as the monomer is copolymerizable with the aromatic-group-containing monomer and the dissociative-group-containing monomer. In particular, an alkyl-group-containing monomer is preferable from the viewpoint of flexibility of the polymer skeleton and ease in regulating the glass transition temperature (Tg).

Examples of the alkyl-group-containing monomer include (meth)acrylic ester monomers such as alkyl(meth)acrylates (such as methyl(meth)acrylate, ethyl(meth)acrylate, isopropyl(meth)acrylate, n-propyl(meth)acrylate, n-butyl(meth) acrylate, isobutyl(meth)acrylate, t-butyl(meth)acrylate, hexyl(meth)acrylate, and ethylhexyl(meth)acrylate), ethylenic unsaturated monomers each having a hydroxyl group (such as hydroxymethyl(meth)acrylate, 2-hydroxyethyl (meth)acrylate, 2-hydroxypropyl(meth)acrylate, 4-hydroxybutyl(meth)acrylate, hydroxypentyl(meth)acrylate, and hydroxyhexyl(meth)acrylate), and dialkylaminoalkyl(meth) acrylates such as dimethylaminoethyl(meth)acrylate; and (meth)acrylamide monomers such as N-hydroxyalkyl(meth) acrylamides (such as N-hydroxymethyl(meth)acrylamide, N-hydroxyethyl(meth)acrylamide, and N-hydroxybutyl (meth)acrylamide) and N-alkoxyalkyl(meth)acrylamides (such as N-methoxymethyl(meth)acrylamide, N-ethoxymethyl(meth)acrylamide, N-(n-, iso)butoxymethyl(meth)acrylamide, N-methoxyethyl(meth)acrylamide, N-ethoxyethyl (meth)acrylamide, and N-(n-, iso)butoxyethyl(meth) acrylamide).

The molecular weight of the water-insoluble polymer forming the self-dispersing polymer is preferably from 3,000 to 200,000, more preferably from 5,000 to 150,000, and still more preferably from 10,000 to 100,000, in terms of weight average molecular weight. When the weight average molecular weight is 3,000 or more, the amount of water-soluble component can be effectively set to a small amount. When the weight average molecular weight is 200,000 or less, the stability of the self-dispersing property can be improved.

The weight average molecular weight is measured with a gel permeation chromatography (GPC). A GPC instrument, HLC-8220GPC manufactured by Tosoh Corporation, is used; the columns (three in number) to be used are TSKgel Super HZM-H, TSKgel SuperHZ4000, and TSKgel SuperHZ2000 (all manufactured by Tosoh Corporation, 4.6 mmID×15 cm); and THF (tetrahydrofuran) is used as an eluent. Regarding the GPC conditions, the sample concentration is 0.3% by mass, the flow rate is 0.35 ml/min, the sample injection amount is 10 μl, and the measurement temperature is 40° C. The detection is performed by using an IR detector. The calibration curve is determined from the following eight samples: standard sample TSK STANDARD POLYSTYRENE, F-40, F-20, F-4, F-1, A-5000, A-2500, A-1000, and n-propylbenzene, all manufactured by Tosoh Corporation.

It is preferable that the water-insoluble polymer forming the self-dispersing polymer particles contains a structural unit derived from an aromatic-group-containing (meth)acrylate monomer (preferably a structural unit derived from phenoxyethyl(meth)acrylate and/or a structural unit derived from benzyl(meth)acrylate) at a copolymerization ratio of from 15 to 80% by mass with respect to the total mass of the self-dispersing polymer particles, from the viewpoint of regulating the hydrophilicity/hydrophobicity of the polymer.

From the viewpoint of regulating the hydrophilicity/hydrophobicity of the polymer, the water-insoluble polymer preferably includes a structural unit derived from an aromatic-group-containing (meth)acrylate monomer at a copolymerization ratio of from 15 to 80% by mass, a structural unit derived from a carboxyl-group-containing monomer, and a structural unit derived from an alkyl-group-containing monomer (preferably a structural unit derived from an alkyl(meth)acrylate), and more preferably includes a structural unit derived from phenoxyethyl(meth)acrylate and/or a structural unit derived from benzyl(meth)acrylate at a total copolymerization ratio of from 15 to 80% by mass, a structural unit derived from a carboxyl-group-containing monomer, and a structural unit derived from an alkyl-group-containing monomer (preferably a structural unit derived from (meth)acrylic ester of an alkyl having 1 to 4 carbon atoms); further it is preferable that the acid value of the water-insoluble polymer is from 25 to 100 mgKOH/g and the weight average molecular weight of the water-insoluble polymer is from 3,000 to 200,000, and it is more preferable that the acid value is from 25 to 95 mgKOH/g and the weight average molecular weight is from 5,000 to 150,000.

Exemplary compounds B-01 to B-19 are shown below, which are examples of the water-insoluble polymer forming the self-dispersing polymer particles. However, the present invention is not limited thereto. The numbers in the parentheses indicate mass ratios of copolymerization components.

B-01: phenoxyethyl acrylate/methyl methacrylate/acrylic acid copolymer (50/45/5)

B-02: phenoxyethyl acrylate/benzyl methacrylate/isobutyl methacrylate/methacrylic acid copolymer (30/35/29/6)

B-03: phenoxyethyl methacrylate/isobutyl methacrylate/methacrylic acid copolymer (50/44/6)

B-04: phenoxyethyl acrylate/methyl methacrylate/ethyl acrylate/acrylic acid copolymer (30/55/10/5)

B-05: benzyl methacrylate/isobutyl methacrylate/methacrylic acid copolymer (35/59/6)

B-06: styrene/phenoxyethyl acrylate/methyl methacrylate/acrylic acid copolymer (10/50/35/5)

B-07: benzyl acrylate/methyl methacrylate/acrylic acid copolymer (55/40/5)

B-08: phenoxyethyl methacrylate/benzyl acrylate/methacrylic acid copolymer (45/47/8)

B-09: styrene/phenoxyethyl acrylate/butyl methacrylate/acrylic acid copolymer (5/48/40/7)

B-10: benzyl methacrylate/isobutyl methacrylate/cyclohexyl methacrylate/methacrylic acid copolymer (35/30/30/5)

B-11: phenoxyethyl acrylate/methyl methacrylate/butyl acrylate/methacrylic acid copolymer (12/50/30/8)

B-12: benzyl acrylate/isobutyl methacrylate/acrylic acid copolymer (93/2/5)

B-13: styrene/phenoxyethyl methacrylate/butyl acrylate/acrylic acid copolymer (50/5/20/25)

B-14: styrene/butyl acrylate/acrylic acid copolymer (62/35/3)

B-15: methyl methacrylate/phenoxyethyl acrylate/acrylic acid copolymer (45/51/4)

B-16: methyl methacrylate/phenoxyethyl acrylate/acrylic acid copolymer (45/49/6)

B-17: methyl methacrylate/phenoxyethyl acrylate/acrylic acid copolymer (45/48/7)

B-18: methyl methacrylate/phenoxyethyl acrylate/acrylic acid copolymer (45/47/8)

B-19: methyl methacrylate/phenoxyethyl acrylate/acrylic acid copolymer (45/45/10)

The method of producing the water-insoluble polymer forming the self-dispersing polymer particles in the present invention is not particularly limited, and may be a method including performing emulsion polymerization in the presence of a polymerizable surfactant so as to covalently bond the surfactant to the water-insoluble polymer or a method including copolymerizing a monomer mixture containing the hydrophilic-group-containing monomer and the aromatic-group-containing monomer by a known polymerization process such as a solution polymerization method or a bulk polymerization method. Among the above polymerization methods, a solution polymerization is preferable, and a solution polymerization method using an organic solvent is more preferable, in consideration of coagulation speed and jetting stability of an ink composition containing the self-dispersing polymer.

From the viewpoint of aggregation speed, the self-dispersing polymer used in the present invention preferably includes a polymer synthesized in an organic solvent, wherein the polymer has carboxyl groups, all or some of the carboxyl groups of the polymer are neutralized, and the polymer is prepared in the form of a polymer dispersion in which water constitutes the continuous phase. In other words, the production of the self-dispersing polymer particles in the present invention preferably includes a step of synthesizing a polymer in an organic solvent and a dispersing step of forming an aqueous dispersion in which at least some of the carboxyl groups of the polymer are neutralized.

The dispersion step preferably includes the following sub-steps (1) and (2):

Sub-step (1): a step of stirring a mixture containing a polymer (water-insoluble polymer), an organic solvent, a neutralizing agent, and an aqueous medium Sub-step (2): a step of removing the organic solvent from the mixture The sub-step (1) is preferably a process in which the polymer (water-insoluble polymer) is dissolved in the organic solvent, and then the neutralizing agent and the aqueous medium are gradually added to the polymer solution and mixed while stirring, thereby forming a dispersion. When the neutralizing agent and the aqueous medium are added to the water-insoluble polymer solution in which the water-insoluble polymer is dissolved in the organic solvent as in the above process, self-dispersing polymer particles whose diameter is highly stable during storage can be obtained without requiring a strong shearing force.

The method of stirring the mixture is not particularly limited, and may be a method using a generally-used mixing and stirring apparatus and/or, if necessary, a disperser such as an ultrasonic disperser or a high-pressure homogenizer.

Preferable examples of the organic solvent described above include an alcohol solvent, a ketone solvent, and an ether solvent.

Examples of the alcohol solvent include isopropyl alcohol, n-butanol, t-butanol, and ethanol. Examples of the ketone solvent include acetone, methylethyl ketone, diethyl ketone, and methylisobutyl ketone. Examples of the ether solvent include dibutyl ether and dioxane. Among the above solvents, ketone solvents such as methylethyl ketone and alcohol solvents such as isopropyl alcohol are preferable. It is also preferable to use isopropyl alcohol and methyl ethyl ketone together for the purpose of making milder the polarity change at the time of phase inversion from an oil phase to an aqueous phase; using the solvents together makes it possible to obtain self-dispersing polymer particles having a very small particle diameter that are free from aggregation precipitation or adhesion between the particles and that have high dispersion stability.

The neutralizing agent is used to neutralize all or some of the dissociative groups of the polymer so as to allow the self-dispersing polymer to get into a stable emulsion or dispersion state in water. When the self-dispersing polymer in the present invention has an anionic dissociative group (e.g., a carboxyl group) as a dissociative group, the neutralizing agent to be used may be a basic compound such as an organic amine compound, ammonia, or an alkali metal hydroxide. Examples of the organic amine compound include monomethylamine, dimethylamine, trimethylamine, monoethylamine, diethylamine, triethylamine, monopropylamine, dipropylamine, monoethanolamine, diethanolamine, triethanolamine, N,N-dimethyl-ethanolamine, N,N-diethyl-ethanolamine, 2-dimethylamino-2-methyl-1-propanol, 2-amino-2-methyl-1-propanol, N-methyldiethanolamine, N-ethyldiethanolamine, monoisopropanolamine, diisopropanolamine, and triisopropanolamine. Examples of the alkali metal hydroxide include lithium hydroxide, sodium hydroxide, and potassium hydroxide. Among them, sodium hydroxide, potassium hydroxide, triethylamine, and triethanolamine are preferable from the viewpoint of dispersion stability in water of the self-dispersing polymer particles used in the present invention The amount of the basic compound to be used is preferably from 5 to 120 mol %, more preferably from 10 to 110 mol %, and still more preferably from 15 to 100 mol %, with respect to 100 mol % of the dissociative group. When the amount of the basic compound is 15 mol % or more, an effect of stabilizing the dispersion of the particles in water can be obtained. When the amount of the basic compound is 120 mol % or less, an effect of decreasing the amount of the water-soluble component can be obtained.

In the sub-step (2), the organic solvent is removed, by distillation, from the dispersion obtained in the sub-step (1) using a common method such as distillation under reduced pressure, whereby phase inversion into an aqueous system occurs and an aqueous dispersion of the self-dispersing polymer particles is obtained. The organic solvent has substantially been removed from the obtained aqueous dispersion, and the amount of the remaining organic solvent is preferably 0.2% by mass or less, and more preferably 0.1% by mass or less.

The volume average particle diameter of the self-dispersing polymer particles is preferably 50 nm or less, and more preferably 40 nm or less, A lower limit of the volume average particle diameter is preferably 5 nm. Especially, it is preferable that the volume average particle diameter is in the range of from 7 nm to 30 nm. When the volume average particle diameter is 5 nm or more, the suitability for production is improved. When the volume average particle diameter is 50 nm or less, discharge reliability is improved.

The particle size distribution of the self-dispersing polymer particles is not particularly limited, and may be a broad particle size distribution or a mono-dispersed particle size distribution.

The average particle diameter and particle size distribution of the self-dispersing polymer particles is obtained by measuring the volume average diameters of the particles by a dynamic light scattering method using NANOTRAC particle size analyzer UPA-EX150 manufactured by Nikkiso Co., Ltd.

The glass transition temperature (Tg) of the self-dispersing polymer is preferably 30° C. or more, more preferably 40° C. or more, and still more preferably 50° C. or more, from the viewpoint of the storage stability of the ink composition.

It is possible to use either one type of self-dispersing polymer or a mixture of two or more types of self-dispersing polymer. The content of the self-dispersing polymer particles in the ink composition is preferably from 1 to 30% by mass, and more preferably from 5 to 15% by mass, with respect to the mass of the ink composition, from the viewpoint of coagulation speed, image gloss, and the like.

In the ink composition, the content ratio of pigment (for example, water-insoluble pigment) to self-dispersing polymer is preferably in the range of from 1/0.5 to 1/10, and more preferably in the range of from 1/1 to 1/4, from the viewpoint of, for example, rubbing resistance of an image.

Among the above-described exemplary embodiments of the invention, it is especially preferable that the weight average acid value of the self-dispersing polymer and the polymer dispersant for the pigment is from 70 to 120 mg KOH/g. If the weight average acid value is in the above-described range, when an ink composition (first-order color image of first color) is applied, and then one or at least two kinds (for example, a second color) of ink composition other than the foregoing ink composition is applied in contact with the foregoing ink composition (for example, so as to overlap), coagulation properties of the ink composition can be maintained in a favorable condition.

The weight average acid value is a value obtained by dividing a total acid value of at least two materials consisting of the self-dispersing polymer and the polymer dispersant, by a total weight of these materials.

The weight average acid value is preferably from 70 to 120 mg KOH/g, and more preferably from 80 to 120 mg KOH/g, from the same viewpoint as described above.

Water-Soluble Organic Solvent

The ink composition used in the present invention may include at least one kind of water-soluble organic solvent. By including the water-soluble organic solvent, effects of drying prevention, moistening, promoting penetration or the like may be obtained. In order to prevent drying, the solvent may be used as a anti-drying agent for preventing nozzle clogging due to aggregation of ink that has attached and dried at an ejection port of a jetting nozzle. In terms of drying prevention or moistening, a water-soluble organic solvent having a lower vapor pressure than that of water is preferably used. In terms of promoting penetration, the solvent may be used as a penetration promoter for improving the penetration ability of ink into a recording medium.

Examples of the water-soluble organic solvent include alkanediols (polyhydric alcohols) such as glycerin, 1,2,6-hexanetriol, trimethylolpropane, ethyleneglycol, propyleneglycol, diethyleneglycol, triethyleneglycol, tetraethyleneglycol, pentaethyleneglycol, dipropyleneglycol, 2-butene-1,4-diol, 2-ethyl-1,3-hexanediol, 2-methyl-2,4-pentanediol, 1,2-octanediol, 1,2-hexanediol, 1,2-pentanediol and 4-methyl-1,2-pentanediol; alkyl alcohols having 1 to 4 carbon atoms such as ethanol, methanol, butanol, propanol and isopropanol; glycol ethers such as ethyleneglycol monomethylether, ethyleneglycol monoethylether, ethyleneglycol monobutylether, ethyleneglycol monomethyletyer acetate, diethyleneglycol monomethylether, diethyleneglycol monoethylether, diethyleneglycol mono-n-propylether, ethyleneglycol mono-iso-propylether, diethyleneglycol mono-iso-propylether, ethyleneglycol mono-n-butylether, ethyleneglycol mono-t-butylether, diethyleneglycol mono-t-butylether, 1-methyl-1-methoxybutanol, propyleneglycol monomethylether, propyleneglycol monoethylether, propyleneglycol mono-t-butylether, propyleneglycol mono-n-propylether, propyleneglycol mono-iso-propylether, dipropyleneglycol monomethylether, dipropyleneglycol monoethylether, dipropyleneglycol mono-n-propylether, dipropyleneglycol mono-iso-propylether; 2-pyrrolidone, N-methyl-2-pyrrolidone, 1,3-dimethyl-2-imidazolidinone, formamide, acetamide, dimethylsulfoxide, sorbit, sorbitan, acetin, diacetin, triacetin, and sulfolane. These water-soluble organic solvents may be used alone or in combination of two or more kinds.

In order to prevent drying or for moisturizing, polyhydric alcohols are usable. Examples of the polyhydric alcohol include glycerin, ethyleneglycol, diethyleneglycol, triethyleneglycol, propyleneglycol, dipropyleneglycol, tripropyleneglycol, 1,3-butanediol, 2,3-butanediol, 1,4-butanediol, 3-methyl-1,3-butanediol, 1,5-pentanediol, tetraethyleneglycol, 1,6-hexanediol, 2-methyl-2,4-pentanediol, polyethyleneglycol, 1,2,4-butanetriol, and 1,2,6-hexanetriol. These polyhydric alcohols may be used alone or in combination of two or more kinds.

In order to promote permeability, a polyol compound is preferable, and an aliphatic diol is suitably used. Examples of the aliphatic diol include 2-ethyl-2-methyl-1,3-propanediol, 3,3-dimethyl-1,2-butanediol, 2,2-diethyl-1,3-propanediol, 2-methyl-2-propyl-1,3-propanediol, 2,4-dimethyl-2,4-pentanediol, 2,5-dimethyl-2,5-hexanediol, 5-hexene-1,2-diol, 2-ethyl-1,3-hexanediol, and 2,2,4-trimethyl-1,3-pentanediol.

Among these, 2-ethyl-1,3-hexanediol and 2,2,4-trimethyl-1,3-pentanediol are mentioned as the preferred examples.

The water-soluble organic solvent may be used alone or in combination of two or more kinds. The content of the water-soluble organic solvent in the ink composition is preferably from 1 to 60% by mass, and more preferably from 5 to 40% by mass.

Water

The ink composition used in the invention may include water, and the content of water in the ink composition is not particularly limited. The content of water in the ink composition is preferably from 10 to 99% by mass, and more preferably from 30 to 80% by mass.

Surfactant

The ink used in the invention may include a surfactant, as necessary. The surfactant may be used as a surface tension adjuster. A compound having a hydrophilic portion and a hydrophobic portion in the molecule, or the like, can be effectively used as the surface tension adjuster, and any of anionic surfactants, cationic surfactants, amphoteric surfactants, nonionic surfactants or betaine surfactants can be used. Further, the aforementioned dispersants (polymer dispersants) can be used as a surfactant.

Specific examples of the anionic surfactant include sodium dodecylbenzene sulfonate, sodium lauryl sulfate, sodium alkyl diphenylether disulfonate, sodium alkyl naphthalene sulfonate, and sodium dialkyl sulfosuccinate. These surfactants may be used alone or in combination of two or more kinds.

Specific examples of the nonionic surfactant include polyoxyethylene laurylether, polyoxyethylene octylphenylether, polyoxyethylene oleylphenylether, polyoxyethylene nonylphenylether, an oxyethylene/oxypropylene block copolymer, t-octylphenoxyethyl polyethoxyethanol, and nonylphenoxyethyl polyethoxyethanol. These surfactants may be used alone or in combination of two or more kinds.

Specific examples of the cationic surfactant include a tetraalkyl ammonium salt, an alkylamine salt, a benzalkonium salt, an alkylpyridium salt, and an imidazolium salt.

When a surfactant is included in the ink, in order to discharge the ink in a favorable manner by an inkjet method, the surfactant is preferably included in an amount by which the surface tension of the ink can be adjusted to a range of from 20 to 60 mN/m, more preferably from 20 to 45 mN/m, and further preferably from 25 to 40 mN/m.

The specific amount of the surfactant in the ink is not particularly limited as long as the surface tension of the ink can be adjusted within the above range, but is preferably 1% by mass or more, more preferably from 1 to 10% by mass, and further preferably from 1 to 3% by mass.

Other Components

The ink may further include various kinds of additives as a component other than the aforementioned components as needed. Examples of the additive include known additives such as UV absorbers, discoloration inhibitors, fungicides, pH adjusters, antirust agents, antioxidants, emulsion stabilizers, antiseptic agents, defoaming agents, viscosity adjusters, dispersion stabilizers, chelate agents, and solid moisturizers.

Examples of a solid moisturizer include sugars such as glucose, mannose, fructose, ribose, xylose, arabinose, galactose, aldonic acid, glucitol, maltose, cellobiose, lactose, sucrose, trehalose and maltotriose; sugar alcohols; hyaluronic acids; and ureas.

Properties of Ink

The surface tension at 25° C. of the ink used in the invention is preferably from 20 mN/m to 60 mN/m, more preferably from 20 mN/m to 45 mN/m, and further preferably from 25 mN/m to 40 mN/m.

The surface tension of the ink described in the present specification is measured using an automatic surface tensiometer (CBVP-Z, trade name, manufactured by Kyowa Interface Science Co., Ltd.) at 25° C.

The viscosity at 25° C. of the ink according to the invention is preferably from 1.2 mPa·s to 15.0 mPa·s, more preferably from 2 mPa·s to less than 13 mPa·s, further preferably from 2.5 mPa·s to 10 mPa·s.

The viscosity of the ink described in the present specification is measured using a viscometer (TV-22, trade name, manufactured by Toki Sangyo Co., Ltd.)

In the process of recording an image according to an inkjet method, a color image is formed by discharging ink, by applying energy thereto, to a recording medium (preferably coated paper) so as to contact a treatment liquid that has been applied to the recording medium. A process described in paragraphs [0093] to [0105] of JP-A No. 2003-306623 can be applied to the invention as a suitable inkjet recording method.

The inkjet method that can be used in the invention is not particularly limited, and known methods are applicable to the invention. Examples of the known method include a charge-control method in which ink is discharged by means of electrostatic attraction; a drop-on-demand method (pressure-pulse method) in which oscillating pressure of a piezo element is utilized; an acoustic inkjet method in which ink is irradiated with acoustic beams converted from electric signals, whereby ink is discharged by means of radiation pressure; a thermal inkjet method (bubble jet method (registered trade mark)) in which pressure generated by heating ink to form air bubbles is utilized. A particularly effective inkjet method is described in JP-A No. 54-59936, in which ink is subjected to action of thermal energy and rapidly changes its volume, and ink is discharged from a nozzle by this change in volume.

The aforementioned inkjet methods also include a method in which an ink having a low color density called photo-ink is discharged in the form of a large number of droplets of a small volume; a method in which inks having a substantially same color hue but different densities are used to improve image quality; and a method in which a colorless, transparent ink is used.

The type of the inkjet head used in the inkjet method may be either on-demand or continuous. Specific examples of the discharge system include an electromechanical-conversion system (such as a single-cavity system, a double-cavity system, a vendor system, a piston system, a share-mode system and a shared-wall system); an electrothermal-conversion system (such as a thermal-inkjet system and a bubble-jet system (registered trade mark)); an electrostatic-suction system (such as an electric-field-control system and a slit-jet system); and an electric-discharge system (such as a spark-jet system). However, the invention is not limited thereto.

An ink nozzle or the like used at the time when an image is recorded according to the aforementioned inkjet methods is not limited in particular, and can be appropriately selected in accordance with the intended use.

In the process of recording an image, particularly in view of suppressing the increase in dot diameter and reducing the variation in dot diameters of ink droplets of different kinds, it is preferable that the ink composition is applied to the acidic surface containing from 0.2 to 0.7 g/m$^2$ of the acidic substance, in a maximum total discharge amount of 15 ml/m$^2$ or less.

In the present specification, the maximum total discharge amount [ml/m$^2$] refers to a maximum amount of the total of discharge amounts of inks per unit area in a recording device for use, and can be calculated by the following expression.

Maximum total discharge amount=Σ(maximum discharge amount of each ink[ml/m$^2$]×discharge ratio of each ink)

For example, when a gray image is recorded with actual discharge amounts of Y=M=C=K=30%, and when maximum discharge amounts of each color are 20 ml/m$^2$, the maximum total discharge amount is 24 ml/m$^2$ (20×0.3+20×0.3+20×0.3+20×0.3=24 ml/m$^2$).

In the inkjet recording method according to the invention, an ink composition is applied to an acidic surface of a recording medium. The recording medium preferably contains, at least at its surface for recording, an acidic substance that coagulates and/or insolubilizes a component in the ink composition. In this case, when the ink composition is applied to the recording surface containing the acidic substance as an acidic surface, the ink coagulates and is fixed in the form of an image on the surface for recording.

Further, in the inkjet recording method according to the invention, the acidic surface can be formed prior to recording an image by carrying out a process of applying, to a region of the recording medium to which the ink composition is to be applied, a treatment liquid containing an acidic substance that coagulates and/or insolubilizes the component of the ink composition. In this case, the ink composition is applied to the acidic surface formed on the recording medium, and the ink composition that contacts the acidic substance contained in the treatment liquid coagulates and is fixed in the form of an image.

The pH (film surface pH; 25±1° C.) at the recording side of the recording medium is, in view of achieving the effects of the invention more effectively, preferably from 3.0 to 6.9, and more preferably from 4.0 to 6.6.

Treatment Liquid

Next, details of the treatment liquid used in the process of applying a treatment liquid are described.

The treatment liquid includes at least an acidic substance that coagulates and/or insolubilizes the aforementioned components of the ink composition, and may further include one or more other components. Since the treatment liquid is used with the ink composition, inkjet recording can be performed at a higher speed, and an image having excellent printing properties with high density and high resolution (including reproducibility of thin lines and minute portions) is obtained even when recording is performed at high speed.

The acidic substance is a compound that can lower the pH of the ink composition, and favorable examples thereof include sulfuric acid, hydrochloric acid, nitric acid, phosphoric acid, polyacrylic acid, acetic acid, glycolic acid, malonic acid, malic acid, maleic acid, ascorbic acid, succinic acid, glutaric acid, fumaric acid, citric acid, tartaric acid, lactic acid, sulfonic acid, orthophosphoric acid, pyrrolidonecarboxylic acid, pyronecarboxylic acid, pyrrolecarboxylic acid, furancarboxylic acid, pyridinecarboxylic acid, coumarin acid, thiophenecarboxylic acid, nicotine acid, derivatives of these compounds, and salts of these compounds. The acidic substance may be used alone or in combination of two or more kinds.

The pH (25° C.) of the treatment liquid is preferably 6 or less, and more preferably 4 or less. Further, the pH (25° C.) of the treatment liquid is preferably in a range of from 0.5 to 4, more preferably in a range of from 0.6 to 4, and particularly preferably in a range of from 0.6 to 3.0. In this case, the pH (25° C.) of the ink composition is preferably 7.5 or higher (more preferably 8.0 or higher).

In particular, in view of improving the density and resolution of the image and increasing the speed of inkjet recording, it is preferable that the pH (25° C.) of the ink composition is 8.0 or higher and the pH (25° C.) of the treatment liquid is from 0.5 to 4.

Further, the acidic substance preferably has a high solubility with respect to water. In view of improving coagulability so that the entire ink can be fixed, the acidic substance is preferably an organic acid, more preferably a divalent or more polyvalent organic acid, particularly preferably a divalent or trivalent acidic substance. The divalent or more polyvalent organic acid is preferably an organic acid having a first pKa of 3.5 or less, and more preferably 3.0 or less. Specifically, suitable examples of the acidic substance include phosphoric acid, oxalic acid, malonic acid, maleic acid and citric acid.

The acidic substance may be used alone or in combination of two or more kinds

The content of the acidic substance in the treatment liquid that coagulates an ink composition is preferably from 1 to 50% by mass, more preferably from 3 to 45% by mass, and further preferably from 5 to 40% by mass.

The treatment liquid may include other additives as long as the effects of the invention are not impaired. Examples of the additives include known additives such as drying inhibitors (moisturizers), discoloration inhibitors, emulsion stabilizers, permeation promoters, UV absorbers, antiseptic agents, fungicides, pH adjusters, surface tension adjusters, defoaming agents, viscosity adjusters, dispersants, dispersion stabilizers, antirust agents, and chelate agents.

In the invention, the recording is preferably carried out using a combination of an ink composition and a treatment liquid that contains an organic acid, the ink composition containing a water-dispersible pigment coated with a polymer dispersant having a carboxylic group and an acid value of from 70 to 120 mg/KOH/g, particles of a self-dispersing polymer having an acid value of from 70 to 120 mg/KOH/g, and a water-soluble organic solvent.

Moreover, the recording is further preferably carried out using a combination of an ink composition and a treatment liquid that contains a divalent or more polyvalent organic acid, the ink composition containing a water-dispersible pigment coated with a polymer dispersant having a carboxylic group and an acid value of from 75 to 120 mg/KOH/g, particles of a self-dispersing polymer having an acid value of from 90 to 120 mg/KOH/g, and a water-soluble organic solvent.

When a process of applying a treatment liquid is carried out, a treatment liquid that coagulates and/or insolubilizes the pigment contained in the ink composition and/or the particles of a self-dispersing polymer is applied to a recording medium, prior to applying the ink composition. Thereafter, the ink composition is applied to contact the treatment liquid that has been applied to the recording medium, thereby forming an image. At this time, the image is fixed on the recording medium by the coagulated and/or insolubilized particles dispersed in the ink composition, including the pigment and/or the polymer particles. As a result, the speed of inkjet recording can be improved, and an image having high levels of density and resolution can be obtained, even when the recording is carried out at high speed.

Application of the treatment liquid can be performed using a known method, such as a coating method, an inkjet method, or an immersion method. The coating method may be a known coating method using a bar coater, an extrusion die coater, an air doctor coater, a blade coater, a rod coater, a knife coater, a squeeze coater, a reverse roll coater, or the like. Details of the inkjet method are as described above.

The amount of the treatment liquid to be applied is not particularly limited as long as the ink composition can be coagulated, and is preferably 0.1 $g/m^2$ or more in terms of the amount of applied acid substance. The amount of the applied acid substance is more preferably from 0.2 to 0.7 $g/m^2$. When the amount of the applied coagulant is 0.1 $g/m^2$ or more, superior high-speed coagulation properties that accord with various types of usage of the inkjet composition are maintained. An acid substance application amount of 0.7 $g/m^2$ or less is preferable in that adverse affects, such as change in gloss, are not given to the surface properties of the recording medium to which the treatment liquid is applied.

In the present invention, it is preferable that a drying-by-heating step of drying the treatment liquid on the recording medium by heating is carried out during a period after the application of the treatment liquid onto a recording medium until the application of the ink composition. By drying the treatment liquid by heating prior to the ink applying step, the ink receiving properties, including suppression of bleed, are improved, and a visible image having superior color density and hue can be recorded.

The drying by heating may be performed with a known heating means, such as a heater, or a heating means utilizing blowing of air, such as a drier, or a means having a combination thereof. Examples of the heating method include: a method of supplying heat from the side of the recording medium opposite to the surface on which the treatment liquid has been applied, using a heater or the like; a method of blowing a warm or hot air to the surface of the recording medium on which the treatment liquid has been applied; a heating method using an infrared heater; and a combination of two or more of the above methods.

Recording Medium

The recording medium is not particularly limited, and may be a cellulose-based general printing paper, such as high-quality paper, coat paper, or art paper, which is used for general offset printing and the like. When image recording is performed on the cellulose-based general printing paper by a general inkjet method using an aqueous ink, absorption and drying of the ink is relatively slow, colorant migration easily occurs after ink dotting, and image quality tends to lower. In contrast, according to the inkjet recording method of the present invention, a high-quality image recording having excellent color density and hue is achieved while suppressing the migration of the colorant.

As the recording medium, a commercially-available product may be used, and examples thereof include high-quality papers (A) such as PRINCE WOOD FREE (trade name) manufactured by Oji Paper Co., Ltd., SHIRAOI (trade name) manufactured by Nippon Paper Industries Co., Ltd., and NEW NPI JOSHITSU (New NPI high-quality; trade name) manufactured by Nippon Paper Industries Co., Ltd.; very light-weight coated papers such as EVER LIGHT COATED (trade name) manufactured by Oji Paper Co., Ltd. and AURORA S (trade name) manufactured by Nippon Paper Industries Co., Ltd.; lightweight coat papers (A3) such as TOPKOTE (L) (trade name) manufactured by Oji Paper Co., Ltd. and AURORA L (trade name) manufactured by Nippon Paper Industries Co., Ltd.; coat papers (A2, B2) such as TOPKOTE PLUS (trade name) manufactured by Oji Paper Co., Ltd. and AURORA COAT (trade name) manufactured by Nippon Paper Industries Co., Ltd.; and art papers (A1) such as 2/SIDE GOLDEN CASK GLOSS (trade name) manufactured by Oji Paper Co., Ltd. and TOKUBISHI ART (trade name) manufactured by Mitsubishi Paper Mills Ltd. As the recording medium, various inkjet-recording papers exclusively for photos may be used.

Among these recording media, coated paper, which is used for general offset printing, is preferable. The coated paper is produced generally by coating a surface of cellulose-based paper (such as high-quality paper or neutral paper), which has not been subjected to surface treatment, with a coating material so as to form a coating layer. When image forming is performed by usual water-based inkjet, the coated paper tends to produce problems in quality, for example in image gloss or rubbing resistance. However, unevenness in gloss is suppressed and an image having excellent gloss and rubbing resistance can be obtained according to the inkjet recording method of the present invention even when the coated paper is used. In particular, it is preferable to use a coated paper having base paper and a coated layer including an inorganic pigment, and it is more preferable to use a coated paper having base paper and a coated layer including kaolin and/or calcium bicarbonate. Specifically, art paper, coat paper, lightweight coat paper, or very light-weight coat paper is preferable.

Inkjet Recording Apparatus

Next, an example of an inkjet recording apparatus favorably used for the image recording method of the present invention will be explained in detail with reference to FIG. 1. FIG. 1 is a rough schematic view showing an example of a structure of the entire inkjet recording apparatus.

As shown in FIG. 1, the inkjet recording apparatus includes: treatment liquid application unit 12, having treatment liquid ejection head 12S that jets the treatment liquid; treatment liquid drying zone 13, having heating unit (not shown) that dries the applied treatment liquid; and ink jetting unit 14 that jets various ink compositions; and ink drying zone 15 at which the jetted ink composition is dried, in this order in the conveyance direction of the recording medium (the direction of the arrow shown in the figure). Further, image fixing unit 16 that fixes an image on the recording medium is provided downstream of ink drying zone 15 in the conveyance direction of the recording medium.

The recording medium that has been supplied to the inkjet recording apparatus is conveyed by conveyance rollers from a feed section to treatment liquid application unit 12, then to treatment liquid drying zone 13, then to ink jetting unit 14, then to ink drying zone 15, and then to mage fixing unit 16 as needed, and then accumulated in an accumulation section. The feed section feeds sheets of the recording medium from a case in which the sheets are loaded. The conveyance of the recording medium may be conducted by a method using conveyance rollers, or methods other than the method using conveyance rollers, and examples of the other methods include a drum conveyance method using a drum-shaped member, a belt conveyance method, or a stage conveyance method using a stage.

Among the plural conveyance rollers provided in the inkjet recording apparatus, at least one roller may be a drive roller to which the force generated by a motor (not shown) is transmitted. By rotating the drive roller at a constant rate using the motor, the recording medium is conveyed in a predetermined direction, at a predetermined conveyance amount.

Treatment liquid application unit 12 has treatment liquid jetting head 12S, which is connected to a storage tank in which the treatment liquid is stored. Treatment liquid jetting head 12S jets the treatment liquid from jetting nozzles disposed to face the recording surface of the recording medium so that droplets of the treatment liquid can be applied onto the recording medium. The method used in treatment liquid application unit 12 is not limited to a method of jetting from a head in the form of a nozzle, and may be a coating method using a coating roller. According to the coating method, the treatment liquid may be readily applied to almost the entire one surface of the recording medium, including an image portion on which ink droplets are to be spotted by ink jetting unit 14 provided at the downstream side. In order to make uniform the thickness of the treatment liquid applied onto the recording medium, an air-knife may be used, or a method of providing a member having an acute angle to give a gap between the member and the recording medium that corresponds to the predetermined amount of treatment liquid.

Treatment liquid drying zone 13 is positioned downstream of treatment liquid application unit 12 in the conveyance direction of the recording medium. Treatment liquid drying zone 13 may include a known heating means such as a heater; an air blower such as a drier; or a combination thereof. The heating may be conducted by a method of disposing a heat-generating member, such as a heater, at a side of the recording medium opposite to the surface applied with treatment liquid wherein, if the recording medium is conveyed automatically, the heat-generating member may be positioned, for example, below the conveyance system that conveys the recording medium placed thereon; or by a method of blowing warm or hot air onto the surface of the recording medium applied with treatment liquid; or by a method of using an infrared heater. Any of these methods may be used singly, or in combination of two or more thereof.

Since the surface temperature of the recording medium may vary depending on the type (material, thickness or the like) of the recording medium and the environmental temperature, it is preferable to dry the treatment liquid while regulating the surface temperature by using a system including a measurement section that measures the surface temperature of the recording medium and a control section that provides the heating control unit with feedback on the temperature measured by the measurement section. The measurement section for measuring the surface temperature of the recording medium is preferably a contact-type or non-contact type thermometer.

The solvent may be removed using, for example, a solvent-removing roller. Alternatively, a method in which excess solvent is removed from the recording medium by an air knife is also applicable.

Ink jetting unit 14 is positioned downstream of treatment liquid drying zone 13 with respect to the conveyance direction of the recording medium. Ink jetting unit 14 includes recording heads (ink jetting heads) 30K, 30C, 30M and 30Y, which are connected to ink reservoirs that store inks of black (K), cyan (C), magenta (M) and yellow (Y), respectively. Each ink reservoir (not shown) stores an ink composition containing at least a pigment of a corresponding color. Further, a self-dispersing polymer and a water-soluble organic solvent are contained in at least one ink composition, and the ink reservoir supplies the ink to the corresponding head among ink jetting heads 30K, 30C, 30M and 30Y, as necessary, when image recording is performed. Further, as shown in FIG. 1, recording heads 30A and 30B for jetting inks of specific colors may be further provided, which are positioned downstream of ink jetting heads 30K, 30C, 30M and 30Y with respect to the conveyance direction of the recording medium, such that recording heads 30A and 30B jet the inks having specific colors as necessary.

Ink jetting heads 30K, 30C, 30M and 30Y jet inks in a manner corresponding to the image to be formed, through jetting nozzles that are positioned so as to face the recording surface of the recording medium. In this way, inks of the respective colors are applied to the recording surface of the recording medium to form a color image.

Treatment liquid jetting head 12S and ink jetting heads 30K, 30C, 30M, 30Y, 30A and 30B are each in the form of full-line head in which a number of jetting ports (nozzles) are aligned along the maximum recording width of the image to be formed on the recording medium. In this form, image recording on a recording medium can be carried out at higher speed compared to serial-type recording in which recording is carried out using a short-length shuttle head that reciprocates in the width direction of the recording medium (in a direction on the plane of the recording medium that is perpendicular to the conveyance direction of the recording medium) in a scanning manner. In the present invention, either of above serial-type recording method or a recording method capable of recording at relatively high speed, such as a single-path system in which the respective heads each extending in the main scanning direction are configured to eject inks of respective colors in single-path manner, may be employed. In the image recording method of the present invention, a high-quality image having high reproducibility may be obtained even in the single-path system.

In the figure, treatment liquid jetting head 12S and ink jetting heads 30K, 30C, 30M, 30Y, 30A and 30B have the same structure.

The application amount of the treatment liquid and the application amount of the ink composition are preferably regulated in accordance with the necessity. For example, the amount of the treatment liquid may be changed according to the type of the recording medium, in order to, for example, adjust the properties such as viscoelasticity of a coagulated product formed upon mixing of the treatment liquid and the ink composition.

Ink drying zone 15 is positioned downstream of ink jetting unit 14 in the conveyance direction of the recording medium. Ink drying zone 15 may have a structure similar to that of treatment liquid drying zone 13.

Image fixing unit 16 may be separately disposed as needed, in order to give a more solid fixation to the recording medium after drying of the image. Image fixing unit 16 is further downstream of ink drying zone 15 in the conveyance direction of the recording medium. In image fixing unit 16, a pair of fixing rollers 40A and 40B is disposed so that these rollers are pressed in contact with each other. The image formed on the recording medium is passed through between fixing rollers 40A and 40B to press and heat the image, whereby fixing properties of the image formed on the recording medium can be improved. Fixing rollers 40A and 40B are preferably a pair of rollers composed of one pressure roller and one heated roller. However, the fixing rollers used in the invention are not limited to the above-described exemplary embodiment.

The inkjet recording apparatus may further include a heating unit at the conveyance path from the feed section to the accumulation section, in order to conduct a heat treatment on the recording medium. For example, by providing a heating unit at a desired position, such as upstream of treatment liquid drying zone 13 or between ink jetting unit 14 and ink drying zone 15, the temperature of the recording medium can be increased to a desired temperature, at which drying and fixing is performed effectively.

EXAMPLES

The present invention will be described below in further details with reference to the following examples. However, the present invention is not limited to these examples as long as the gist of the invention is retained. Moreover, the term "part" refers to "part by mass" unless otherwise noted.

The weight average molecular weight was measured according to gel permeation Chromatography (GPC). GPC was conducted using HLC-8220GPC (manufactured by Tosoh Corporation), three columns: TSKgeL Super HZM-H, TSKgeL Super HZ4000, and TSKgeL Super HZ2000 (each manufactured by Tosoh Corporation) connected in series, and THF (tetrahydrofuran) as an elution. Further, GPC was performed using an IR detector under the conditions of reagent concentration: 0.35% by mass, flow velocity: 0.35 ml/min, injected amount of sample: 10 μl, and measuring temperature: 40° C. The standard curve was prepared using a standard sample TSK standard, polystyrene: eight samples composed of F-40, F-20, F-4, A-500, A-2500, A-1000 and n-propylbenzene, manufactured by Tosoh Corporation.

Examples 1 to 3, Comparative Example 1

Preparation of Aqueous Ink

Synthesis of Polymer Dispersant a 6 parts of styrene, 11 parts of stearyl methacrylate, 4 parts of styrene macromer (AS-6, trade name, manufactured by Toagosei Co., Ltd.), 5 parts of BLEMMER PP-500 (trade name, manufactured by NOF Corporation), 5 parts of methacrylic acid, 0.05 parts of 2-mercapto ethanol, and 24 parts of methyl ethyl ketone were added into a reaction vessel to prepare a mixed solution.

Separately, 14 parts of styrene, 24 parts of stearyl methacrylate, 9 parts of styrene macromer AS-6 (trade name, manufactured by Toagosei Co., Ltd.), 9 parts of BLEMMER PP-500 (trade name, manufactured by NOF Corporation), 10 parts of methacrylic acid, 0.13 parts of 2-mercaptoethanol, 56 parts of methyl ethyl ketone, and 1.2 parts of 2,2'-azobis(2,4-dimethylvaleronitrile) were added into a dripping funnel to prepare a mixed solution.

In a nitrogen atmosphere, the mixed solution in the reaction vessel was heated to 75° C. while stirring, and the mixed solution in the dripping funnel was gradually dripped into the reaction vessel over one hour. Two hours after the completion of the dripping, 12 parts of methyl ethyl ketone in which 1.2 parts of 2,2'-azobis(2,4-dimethylvaleronitrile) was dissolved was dripped into the reaction vessel over three hours. The mixed solution was further aged at 75° C. for two hours and then at 80° C. for two hours, thereby obtaining a solution of polymer dispersant a.

A part of the polymer dispersant a in a solvent was isolated by removing the solvent, and the obtained solid content was diluted with tetrahydrofuran to 0.1 mass % to obtain a sample. The sample was subjected to high-speed GPC (gel permeation chromatography) in order to measure a weight average molecular weight of the polymer. The weight average molecular weight of the polymer as measured was 25,000 (as a polystyrene-equivalent value), and the acid value of the polymer was found to be 117 mgKOH/g.

The acid value was measured according to a method described in JIS standard (JIS K0070: 1992). This is also applied to any of examples described below.

Synthesis of Polymer Dispersants b and c (for Comparison)

Polymer dispersants b and c were synthesized in a similar manner to the synthesis of polymer dispersant a, except that the ratio by part of the monomer components and the amount by part of the initiator (2,2'-azobis(2,4-dimethylvaleronitrile) were changed as shown in the following Table 1.

TABLE 1

| Polymer dispersant | styrene | SMA | AM AS-6 | PP-500 | MAA | ME | Initiator |
|---|---|---|---|---|---|---|---|
| a | 20 | 35 | 13 | 14 | 15 | 0.18 | 2.4 |
| b | 27 | 35 | 13 | 14 | 8 | 0.18 | 2.4 |
| c | 18 | 35 | 13 | 14 | 17 | 0.18 | 2.4 |

SMA: Stearyl methacrylate
SM AS-6: Styrene macromer AS-6
PP-500: BLEMMER PP- 500 (trade name)
MAA: Methacrylic acid
ME: 2-mercaptoethanol Synthesis of Fine Particles of Self-Dispersing Polymer Synthesis of Self-Dispersing Polymer Latex A 360.0 g of methyl ethyl ketone was placed in a 2 L three-necked flask equipped with a stirrer, a thermometer, a reflux condenser, and a nitrogen gas introduction tube, and was heated to 75° C. Thereafter, while the temperature inside the flask was maintained at 75° C., a mixture solution of 180.0 g of phenoxyethyl acrylate (PhOEA), 158.4 g of methyl methacrylate (MMA), 21.6 g of acrylic acid (AA), 72 g of methyl ethyl ketone, and 1.44 g of V-601 (trade name, manufactured by Wako Pure Chemical Industries Ltd.) was added drop-wise into the flask at a constant rate such that the drop-wise addition was completed in 2 hours. After the drop-wise addition was completed, a solution of 0.72 g of V-601 in 36.0 g of methyl ethyl ketone was added into the flask, stirred at 75° C. for 2 hours, and a solution of 0.72 g of V-601 in 36.0 g of isopropanol was further added, and the contents of the flask were stirred at 75° C. for 2 hours. Then, the temperature inside the flask was increased to 85° C., and stirring was continued for another 2 hours. As a result, a resin solution of a copolymer of phenoxyethyl acrylate/methyl methacrylate/acrylic acid (in a ratio of 50/45/6 by mass) was obtained.

The weight average molecular weight (Mw) of the obtained copolymer as measured in a similar manner to the above was 64,000 (calculated as polystyrene-equivalent value according to gel permeation chromatography (GPC)). The acid value of the copolymer was found to be 46.8 mgKOH/g.

Then, 668.3 g of the obtained resin solution was weighed, and 388.3 g of isopropanol and 145.7 ml of a 1 mol/L NaOH aqueous solution were added to the resin solution, and then the temperature inside the reaction vessel was elevated to 80° C. Thereafter, 720.1 g of distilled water was added drop-wise into the reaction vessel at a rate of 20 ml/min so as to form water dispersion. The contents of the reaction vessel was allowed to stand, under atmospheric pressure, at a reaction vessel inside temperature of 80° C. for 2 hours, and then 85° C. for 2 hours, and then 90° C. for 2 hours. Subsequently, the inside of the reaction vessel was depressurized, and the isopropanol, the methyl ethyl ketone, and the distilled water were removed in a total amount of 913.7 g. As a result, self-dispersing polymer latex A (water dispersion of self-dispersing polymer fine particles) having a solid concentration of 28.0% by mass was obtained.

A volume average particle diameter of the self-dispersing polymer latex A was measured according to a dynamic light scattering method using a NANOTRAC particle size distribution meter UPA-EX 150 (trade name, manufactured by Nikkiso Co., Ltd.). As a result, the volume average particle diameter was found to be 20 nm.

Synthesis of Self-Dispersing Polymer Latexes B to F

Self-dispersing polymer latexes B to F were synthesized in a similar manner to the synthesis of self-dispersing polymer latex A, except that the amount of acrylic acid was increased and the ratios (mass ratios) of phenoxyethylacrylate (PhOEA), methyl methacrylate (MMA), and acrylic acid (AA) were changed as shown in the following Table 2.

The weight average molecular weight (Mw), volume average particle diameter, and acid value of the self-dispersing polymer latexes are also shown in Table 2.

TABLE 2

| | MMA [mass %] | PhOEA [mass %] | AA [mass %] | Mw | volume average particle diameter | acid value [mgKOH/g] |
|---|---|---|---|---|---|---|
| Polymer latex A | 44 | 50 | 6 | 64000 | 20 nm | 46.8 |
| Polymer latex B | 42 | 50 | 8 | 63000 | 10 nm | 62.4 |
| Polymer latex C | 40 | 50 | 10 | 64000 | 13 nm | 78.0 |
| Polymer latex D | 38 | 50 | 12 | 63800 | 13 nm | 93.6 |
| Polymer latex E | 35 | 50 | 15 | 65000 | 12 nm | 117.0 |
| Polymer latex F | 33 | 50 | 17 | 64000 | 25 nm | 132.6 |

Preparation of Ink

Preparation of Cyan Ink C-1

Next, 5.0 g (in terms of solid content) of the obtained polymer dispersant solution a, 10.0 g of a cyan pigment (Pigment Blue 15:3, manufactured by Dainichiseika Color & Chemicals Mfg. Co., Ltd.), 40.0 g of methyl ethyl ketone, 8.0 g of 1 mol/L (liter) sodium hydroxide, and 82.0 g of ion exchange water were put in a vessel together with 300 g of 0.1 mm zirconia beads, and were dispersed for 6 hours at 1,000 rpm with a disperser Ready Mill (trade name, manufactured by Aimex Co., Ltd.). The resulting dispersion liquid was condensed under reduced pressure using an evaporator until methyl ethyl ketone was sufficiently removed, and the dispersion liquid was further condensed until the concentration of pigment reached 10%. Cyan pigment dispersion liquid C1 was thus obtained, in which the water-dispersible pigment was dispersed.

The volume average particle diameter (of the secondary particles) of the cyan dispersion liquid C1 as measured by a dynamic light scattering method using a particle size distribution meter MICROTRAC Version 10.1.2-211 BH (trade name, manufactured by Nikkiso Co., Ltd.) was 77 nm.

After the cyan dispersion liquid C1 was prepared as described above, the cyan dispersion liquid C1 was mixed with self-dispersing polymer A, an organic solvent, a surfactant, and ion-exchange water, so that an ink having the following composition was prepared. After the preparation of the ink, the ink was filtered through a 5 μm membrane filter so as to remove coarse particles, whereby a cyan ink C-1 was obtained.

The pH value (25±1° C.) of cyan ink M-1 as measured by using a pH meter (WM-50EG, trade name, manufactured by DKK-Toa Corporation) was 8.7.

<Composition of Cyan Ink C-1>

| | |
|---|---|
| Cyan pigment (Pigment blue 15:3, manufactured by Dainich Color and Chemicals Mfg. Co., Ltd.) | 4% by mass |
| Polymer dispersant solution a (solid content) as described above | 2% by mass |
| Self-dispersing polymer latex A as described above | 4% by mass |
| SANNIX GP250 (hydrophilic organic solvent) (trade name, manufactured by Sanyo Chemical Industries Ltd.) | 10% by mass |
| Diethyleneglycol monoethylether (DEGmEE, manufactured by Wako Pure Chemical Industries Ltd.) | 5% by mass |
| OLFINE E1010 (trade name, manufactured by Nissin Chemical Industry Co., Ltd.) | 1% by mass |
| Ion-exchange water | 74% by mass |

Preparation of Cyan Inks C-2 to C-6

Cyan inks C-2 to C-6 were prepared in a similar manner to the preparation of cyan ink C-1, except that the self-dispersing polymer latex A was changed to self-dispersing polymer latexes B to F as prepared above, respectively. The pH values (25±1° C.) of cyan inks C-2 to C-6 as measured in the same manner as above were 8.6, respectively.

Preparation of Magenta Ink M-1

Magenta ink M-1 was prepared in a similar manner to the preparation of cyan ink C-1, except that the pigment (Pigment Blue 15:3) was changed to Cromophtal Jet Magenta DMQ (PR-122, trade name, manufactured by Ciba Japan, K.K.)

The pH value (25±1° C.) of magenta pigment ink M-1 as measured by using a pH meter (WM-50EG, trade name, manufactured by DKK-Toa Corporation) was 8.7.

Preparation of Magenta Inks M-2 to M-6

Magenta inks C-2 to C-6 were prepared in a similar manner to the preparation of magenta ink M-1, except that self-dispersing latex A was changed to the above self-dispersing polymer latexes B to F, respectively. The pH values (25±1° C.) of magenta inks M-2 to M-6 as measured in the same manner as above were 8.7, respectively.

Preparation of Aqueous Treatment Liquid

A treatment liquid was prepared as described below.

Preparation of Treatment Liquid B-1

The components of the following composition were mixed to form a treatment liquid B-1. The pH (25±1° C.) of treatment liquid B-1 as measured in the same manner as above was 0.6.

Composition of Treatment Liquid B-1

| | |
|---|---|
| Malonic acid (manufactured by Wako Pure Chemical Industries Ltd.) | 25% by mass |
| Diethyleneglycol monomethyl ether (DEGmEE, manufactured by Wako Pure Chemical Industries Ltd.) | 20% by mass |
| Ion-exchange water | 55% by mass |

Preparation of Treatment Liquid B-2

The components of the following composition were mixed to form a treatment liquid B-2. The pH (25±1° C.) of treatment liquid B-2 as measured in the same manner as above was 0.7.

Composition of Treatment Liquid B-2

| | |
|---|---|
| Malonic acid (manufactured by Wako Pure Chemical Industries Ltd.) | 15% by mass |
| Diethyleneglycol monomethyl ether (DEGmEE, manufactured by Wako Pure Chemical Industries Ltd.) | 20% by mass |
| Ion-exchange water | 65% by mass |

Image Recording and Evaluation

The thus-obtained inks and aqueous treatment liquids were used in the combinations described in Table 3 below, and images were recorded as described below. The recorded images were evaluated with respect to image (coagulability) and ink stability according to the below-described method. The evaluation results are as shown in Table 3 below.

Image Recording

First, an inkjet apparatus was prepared which has, as shown in FIG. 1, treatment liquid application unit 12 equipped with treatment liquid jetting head 12S that jets an aqueous treatment liquid, treatment liquid drying zone 13 that dries the applied aqueous treatment liquid, ink jetting unit 14 that jets various ink compositions, ink drying zone 15 that dries the applied ink composition, and image fixing unit 16 equipped with heated press rolls capable of fixing a dried image by heating and applying pressure are provided sequentially in the conveyance direction of the recording medium (the direction of the arrow shown in the figure).

Although not shown in the figure, treatment liquid drying zone 13 has an air blower at the recording surface side of the recording medium that supplies dry air so as to dry the treatment liquid, and an infrared heater at the non-recording surface of the recording medium. Treatment liquid drying zone 13 is configured such that water contained in the aqueous treatment liquid is evaporated (dried) off after the application of the treatment liquid is started at the treatment liquid application unit, by regulating the temperature and air volume. In ink jetting unit 14, black-ink jetting head 30K, cyan-ink jetting head 30C, magenta-ink jetting head 30M, and yellow-ink jetting head 30Y are disposed in this order in the conveyance direction (the direction of the arrow). Each of the heads is a 1200 dpi/10 inch-wide full-line head having a driving frequency of 25 kHz and a recording medium conveyance velocity of 530 mm/sec. The respective heads are configured to jet inks of respective colors in a single-pass manner while moving in the fast scanning direction relative to the recording medium. In image fixing unit 16, temperature of press rolls 40A and 40B is regulated at 80° C., respectively.

The treatment liquid, cyan ink and magenta ink prepared above were charged into storage tanks (not shown in the figure) respectively connected to treatment jetting head 12S, cyan ink jetting head 30C and magenta ink jetting head 30 M of the inkjet apparatus that was configured as shown in FIG. 1, and a solid image and a 1200 dpi line image were recorded on a recording medium. In this time, first, an aqueous treatment liquid was jetted on the recording medium. Thereafter, a magenta ink as an ink of a first color (first-order color) was jetted on the jetted aqueous treatment liquid, and then a cyan ink as an ink of a second color (second-order color) was jetted thereon. The amount of the aqueous treatment liquid applied to the recording medium was 1.7 g/m$^2$. Herein, the amount of maleic acid (acidic substance) applied to the recording medium was set to be 0.425 g/m$^2$. As the recording medium, U-LITE (having a basis weight of 84.9 g/m$^2$, (trade name, manufactured by Nippon Paper Industries Co., Ltd.) was used.

During the image recording, the aqueous treatment liquid, the cyan ink and the magenta ink were jetted at a resolution of 1200 dpi×600 dpi, an ink amount per droplet of 3.5 pl and an ink jetting rate of 100%. The line image was recorded by jetting in a single-pass manner so as to form a line having a width of 1 dot, a line having a width of 2 dots, and a line having a width of 4 dots along the fast scanning direction. Regarding the formation of the solid image, a sheet of the recording medium was cut into an A5-size to prepare a sample, and a solid image was formed by jetting the ink onto one entire surface of the sample.

When the images were recorded, the treatment liquid was jetted from treatment liquid jetting head 12S onto the recording medium in a single-pass manner, and then the treatment liquid was dried in treatment liquid drying zone 13. In this time, the recording medium was controlled so as to pass through the treatment liquid drying zone within the time rang of from the initiation of jetting the aqueous treatment liquid until 900 msec. In treatment liquid drying zone 13, while the spotted aqueous treatment liquid was heated with an infrared heater from the side (back side) of the recording medium that was opposite to the surface at which the treatment liquid was spotted such that the surface temperature of the spotted treatment liquid was maintained at 40 to 45° C., hot air having a temperature of 120° C. was blown from a blower to the recording surface, and the air volume was changed to achieve a desired drying amount. Subsequently, the magenta ink was jetted from magenta ink jetting head 30M in a single pass manner to record a first-order color image of magenta color. Then, the cyan ink was jetted from cyan ink jetting head 30C on top of the magenta ink in a single pass manner to record a second-order color image of cyan color on the first-order color image. Then, in a manner similar to the above, drying of the ink was performed in ink drying zone 15 by blowing a hot air having a temperature of 120° C. and a velocity of 5 m/sec from a blower to the recording surface for 15 seconds while heating the spotted ink with an infrared heater from the side (back side) of the recording medium that was opposite to the surface at which the ink was spotted.

After drying the image, the image was fixed by repeatedly carrying out three times an operation (process) of heating and applying pressure at a nip pressure of 1.0 mPa, using press rollers 40A and 40B which had been temperature-modulated at 80° C. (formed from a totally fluorinated thermoplastic fluororesin, which is a copolymer of tetrafluoroethylene (TFE) and perfluoroalkoxyethylene).

Evaluation of Image Quality

1. Coagulability (Measurement of Dot Diameter)

Dot diameters of a first-order color image (magenta) and a second-order color image (cyan) recorded in the above were measured by using a dot analyzer (DA6000, trade name, manufactured by Oji Scientific Instruments), and were used as the indicator for evaluating the coagulability of the ink (resolution of the image). The dot diameter is more favorable when the variation in dot diameters of the first and second-order color images (Δ diameter) is smaller, and this variation (Δ diameter) is preferably 2.5 μm or less.

2. Stability of Ink

25% by weight of diethyleneglycol monobutylether (DEGmBE) was added to the inks of each color obtained in the above process, and the inks were allowed to stand at 60° C. for five weeks. Thereafter, the number of coarse particles having a diameter of from 0.8 to 5 μm was measured by using FP-3000 (trade name, manufactured by Sysmex Corporation), and was evaluated in accordance with the following criteria.

<Evaluation Criteria>

A: The number of coarse particles is less than 10 times that before the addition of DEGmBE.

B: The number of coarse particles is 10 times or greater than that before the addition of DEGmBE.

TABLE 3

| | Ink type | | | *4 [mg | *5 [mg | *6 [mg | *7 | Evaluation of image (coagulability) Treatment liquid B-1 [Maleic acid 25%] first-order dot | Second-order dot | Δ Diam- | Treatment liquid B-2 [Maleic acid 25%] First-order dot | Second-order dot | Δ Diam- | | |
|---|---|---|---|---|---|---|---|---|---|---|---|---|---|---|---|
| | | *4 | *5 | KOH/g] | KOH/g] | KOH/g] | [ms] | diameter | diameter | eter | diameter | diameter | eter | *8 | *9 |
| Ex | C-1, M-1 | A | a | 46.8 | 117 | 81.9 | 100 | 31 | 37 | 6 | 31 | 40 | 9 | A | Comp. |
| 1 | C-2, M-2 | B | a | 62.4 | 117 | 89.7 | 100 | 31 | 36 | 5 | 31 | 37 | 6 | A | Comp. |
| | C-3, M-3 | C | a | 78 | 117 | 97.5 | 100 | 31.1 | 31.5 | 0.4 | 31.3 | 32.4 | 1.1 | A | Invention |
| | C-4, M-4 | D | a | 93.6 | 117 | 105.3 | 100 | 31.1 | 31.3 | 0.2 | 31.5 | 31.9 | 0.4 | A | Invention |
| | C-5, M-5 | E | a | 117 | 117 | 117 | 100 | 31.3 | 31.5 | 0.2 | 31.8 | 32.8 | 1 | A | Invention |
| | C-6, M-6 | F | a | 132.6 | 117 | 124.8 | 100 | 32 | 32.2 | 0.2 | 33.5 | 36.2 | 2.7 | A | Comp. |
| Ex | C-1, M-1 | A | a | 46.8 | 117 | 81.9 | 250 | 31 | 35 | 4 | 31 | 37 | 6 | A | Comp. |
| 2 | C-2, M-2 | B | a | 62.4 | 117 | 89.7 | 250 | 31 | 33.6 | 2.6 | 31 | 35.2 | 4.2 | A | Comp. |
| | C-3, M-3 | C | a | 78 | 117 | 97.5 | 250 | 31.1 | 32 | 0.9 | 31.3 | 32 | 0.7 | A | Invention |
| | C-4, M-4 | D | a | 93.6 | 117 | 105.3 | 250 | 31.1 | 31.3 | 0.2 | 31.5 | 32.1 | 0.6 | A | Invention |
| | C-5, M-5 | E | a | 117 | 117 | 117 | 250 | 31.3 | 31 | 0.3 | 31.8 | 32.4 | 0.6 | A | Invention |
| | C-6, M-6 | F | a | 132.6 | 117 | 124.8 | 250 | 32 | 32 | 0 | 33 | 36 | 3 | A | Comp. |
| | C-2, M-2 | B | b | 62.4 | 62.4 (*1) | 62.4 | 250 | Jetting was not stable | | | Jetting was not stable | | | A | Comp. |
| | C-2, M-2 | B | c | 62.4 | 132.6 (*2) | 97.5 | 250 | 31.5 | 31.7 | 0.2 | 32.5 | 33.3 | 0.8 | B | Comp. |
| | | — | | | 70 | 70 | 250 | 34 | 35 | 1 | 37 | (*3) | — | A | Comp. |
| Ex | C-1, M-1 | A | a | 46.8 | 117 | 81.9 | 500 | 31 | 33 | 2 | 31 | 34.5 | 3.5 | A | Comp. |
| 3 | C-2, M-2 | B | a | 62.4 | 117 | 89.7 | 500 | 31 | 32.5 | 1.5 | 31 | 33.6 | 2.6 | A | Comp. |
| | C-3, M-3 | C | a | 78 | 117 | 97.5 | 500 | 31.1 | 32 | 0.9 | 31.3 | 32 | 0.7 | A | Invention |
| | C-4, M-4 | D | a | 93.6 | 117 | 105.3 | 500 | 31.1 | 31.3 | 0.2 | 31.5 | 32.1 | 0.6 | A | Invention |
| | C-5, M-5 | E | a | 117 | 117 | 117 | 500 | 31.3 | 31 | 0.3 | 31.8 | 32 | 0.2 | A | Invention |
| | C-6, M-6 | F | a | 132.6 | 117 | 124.8 | 500 | 32 | 32 | 0 | 33.5 | 36.3 | 2.8 | A | Comp. |
| Ref. Ex. | C-3, M-3 | C | a | 78 | 117 | 97.5 | 700 | 31.1 | 31 | 0.1 | 31.3 | 31.7 | 0.4 | A | Comp. |

*1 Polymer dispersant b
*2 Polymer dispersant c
*3 The image was not resolved.
*4 Polymer latex
*5 Polymer dispersant
*6 Weight average acid value
*7 Dotting interval
*8 Evaluation of addition of DEGmBE
*9 Note
The abbreviations "Ex.", "Ref. Ex." and "Comp." in Table 3 indicate "Example", "Reference Example" and "Comparison", respectively.

As shown in Table 3, in the invention, spreading of ink droplets of the second color was suppressed and the variation in dot diameters of the first and second-order color images (Δ diameter) was small, when inks of plural colors were discharged at a dotting interval of 500 msec or less. As a result, a high-quality image was recorded in a stable manner at a speed of as high as 500 msec or less.

Figure 2:
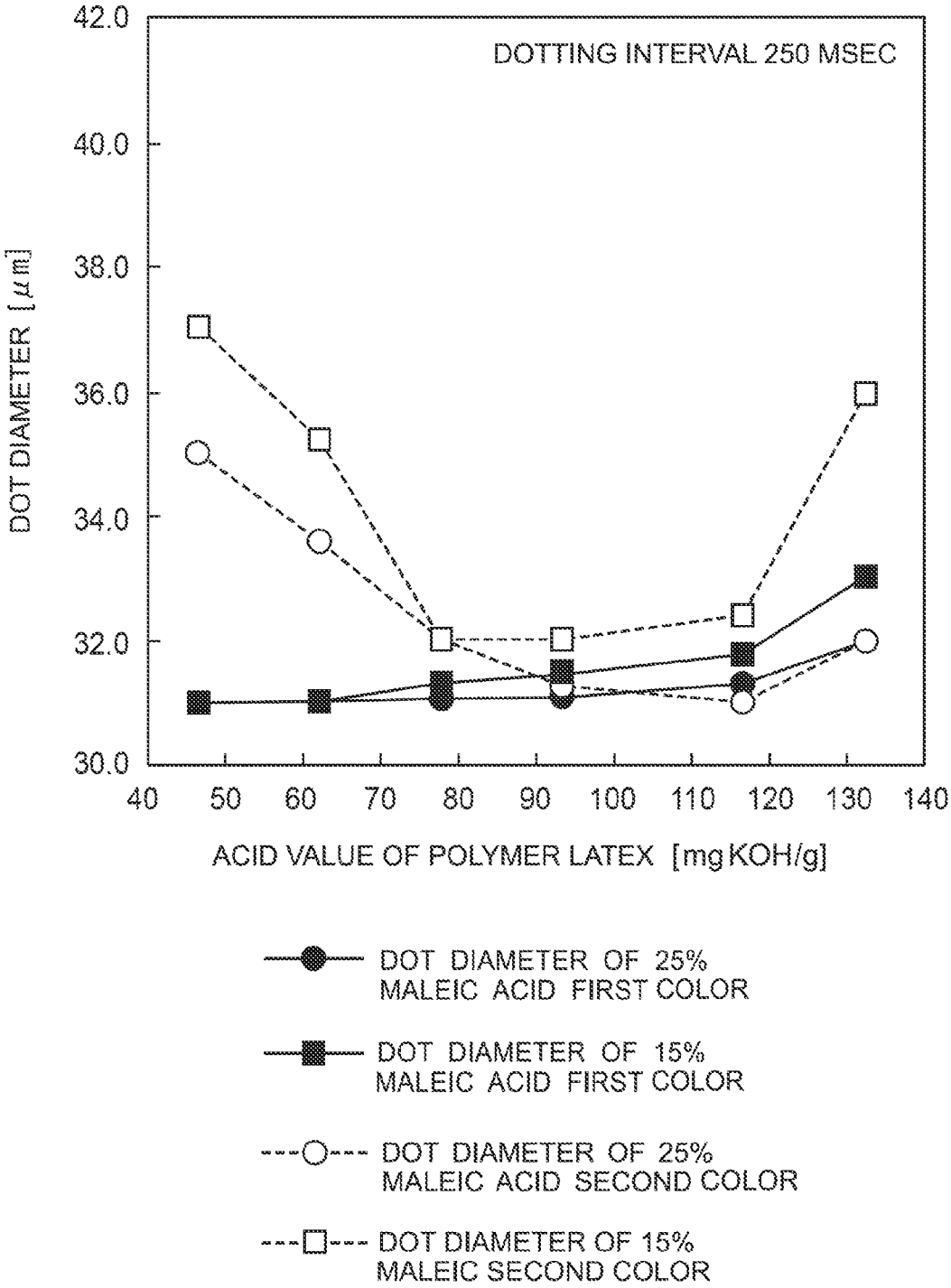
FIG. 2 is a graph showing a relationship between the acid value of the polymer latex and the dot diameter.

FIG. 2 is a graph showing the relationship between the acid value of the polymer latex (self-dispersing polymer) and the dot diameter as measured at a dotting interval of 250 msec.

On the other hand, in the Comparative Examples, ink droplets of the second color tended to spread when the acid value was low (<70 mgKOH/g) while the acid value dependency increased when the acid value was high (<120 mgKOH/g). As a result, a high-quality multicolor image having uniform dot diameters was not recorded at a speed of as high as 500 msec or less, in both cases. In particular, since the reduction in the amount of acid in the treatment liquid resulted in a significant variation in dot diameters, the amount of acid in the treatment liquid was severely restricted. Moreover, when not only the acid value of the self-dispersing polymer but also the acid value of the polymer dispersant was outside the range of from 70 to 120 mgKOH/g, ink jetting itself was instable.

Further, as shown in the Reference Example, when the dotting interval is long (>500 msec), variation in dot diameters caused by insufficient coagulation is not significant.

All publications, patent applications, and technical standards mentioned in this specification are herein incorporated by reference to the same extent as if each individual publication, patent applications, or technical standards was specifically and individually indicated to be incorporated by reference.

What is claimed is:

1. An inkjet recording method comprising:

recording an image, on a recording medium, using two or more ink compositions each comprising at least a pigment; by applying the two or more ink compositions to an acidic surface of the recording medium at a dotting interval of 500 msec or less; wherein the recording comprises forming at least a first color sub-image by applying at least one of the two or more ink compositions and then forming a second color sub-image by applying at least another of the two or more ink compositions onto the first color sub-image at the dotting interval of 500 msec or less, and the at least one of the two or more ink compositions comprises a self-dispersing polymer having an acid value of from 70 to 120 mgKOH/g and a water-soluble organic solvent.

2. The inkjet recording method according to claim 1, wherein the recording medium comprises, at least at a side of the recording medium on which the image is recorded, an acidic substance that forms the acidic surface and that coagulates or insolubilizes a component of the ink composition, and the ink composition is applied to the side of the recording medium that comprises the acidic substance.

3. The inkjet recording method according to claim 1, further comprising, prior to recording the image, a process of forming the acidic surface by applying a treatment liquid to a region of the recording medium to which the inkjet composition is to be applied, the treatment liquid including an acidic substance that coagulates or insolubilizes the component of the ink composition.

4. The inkjet recording method according to claim 1, wherein the pigment is a water-dispersible pigment having at least a portion of a surface thereof coated with a polymer dispersant.

5. The inkjet recording method according to claim 4, wherein the polymer dispersant has a carboxyl group.

6. The inkjet recording method according to claim 4, wherein the polymer dispersant has an acid value of from 70 to 120 mgKOH/g.

7. The inkjet recording method according to claim 4, wherein the weight average acid value of the self-dispersing polymer and the polymer dispersant is from 70 to 120 mgKOH/g.

8. The inkjet recording method according to claim 1, wherein the ink composition is applied, in a maximum jetting amount of 15 $ml/m^2$ or less, to the acidic surface that includes an acidic substance in an amount of from 0.2 to 0.7 $g/m^2$.

9. The inkjet recording method according to claim 1, wherein the volume average particle diameter of the self-dispersing polymer is 50 nm or less.

10. The inkjet recording method according to claim 2, wherein the acid substance is a divalent or more polyvalent organic acid.

11. The inkjet recording method according to claim 10, wherein the divalent or more polyvalent organic acid is an organic acid having a first pKa of 3.5 or less.

12. The inkjet recording method according to claim 3, wherein the content of the acidic substance included in the treatment liquid is from 1 to 50% by mass with respect to the treatment liquid.

13. The inkjet recording method according to claim 3, further comprising drying the treatment liquid on the recording medium by heating during a period from after the application of the treatment liquid onto the recording medium until the application of the ink composition.

14. The inkjet recording method according to claim 1, wherein the recording medium is a coated paper medium comprising a base paper and a coating layer including an inorganic pigment.

15. The inkjet recording method according to claim 1, wherein the ink composition comprises water in an amount of from 10% to 99% by mass with respect to the ink composition.

16. An inkjet recording method comprising:

recording an image, on a recording medium, using a combination of two or more ink compositions, each comprising at least a pigment, and a treatment liquid that includes an organic acid, by applying the two or more ink compositions to an acidic surface of the recording medium at a dotting interval of 500 msec or less; wherein the recording comprises forming at least a first color sub image by applying at least one of the two or more ink compositions and then forming a second color sub-image by applying at least another of the two or more ink compositions onto the first color sub-image at the dotting interval of 500 msec or less, and the ink composition forming the at least a first color sub image comprises a water-dispersible pigment coated with a polymer dispersant having a carboxylic group and an acid value of from 70 to 120 mgKOH/g, particles of a self-dispersing polymer having an acid value of from 70 to 120 mgKOH/g and a water-soluble organic solvent.

17. An inkjet recording method comprising:

recording an image, on a recording medium, using a combination of two or more ink compositions, each comprising at least a pigment, and a treatment liquid that includes a divalent or more polyvalent organic acid, by applying the two or more ink compositions to an acidic surface of the recording medium at a dotting interval of 500 msec or less; wherein the recording comprises forming at least a first color sub-image by applying at least one of the two or more ink compositions and then forming a second color sub-image by applying at least another of the two or more ink compositions onto the first color sub-image at the dotting interval of 500 msec or less, and the ink composition forming the at least a first color sub-image comprises a water-dispersible pigment coated with a polymer dispersant having a carboxylic group and an acid value of from 75 to 120 mgKOH/g, particles of a self-dispersing polymer having an acid value of from 90 to 120 mgKOH/g, and a water-soluble organic solvent.

* * * * *